United States Patent [19]

Matsushita et al.

[11] Patent Number: 4,774,998

[45] Date of Patent: Oct. 4, 1988

[54] METHOD AND APPARATUS FOR PREVENTING CAST DEFECTS IN CONTINUOUS CASTING PLANT

[75] Inventors: Akira Matsushita, Sakai; Wataru Ohashi, Tokyo; Masami Temma, Sakai; Takeyoshi Ninomiya, Sakai; Kazuhiko Tsutsumi, Sakai, all of Japan

[73] Assignee: Nippon Steel Corporation, Tokyo, Japan

[21] Appl. No.: 143,270

[22] Filed: Jan. 4, 1988

Related U.S. Application Data

[63] Continuation of Ser. No. 823,241, Jan. 28, 1986, abandoned.

[30] Foreign Application Priority Data

| | | | |
|---|---|---|---|
| Feb. 1, 1985 | [JP] | Japan | 60-16660 |
| Mar. 1, 1985 | [JP] | Japan | 60-40767 |
| Apr. 10, 1985 | [JP] | Japan | 60-75524 |
| Apr. 10, 1985 | [JP] | Japan | 60-75525 |
| Jul. 18, 1985 | [JP] | Japan | 60-158770 |
| Nov. 25, 1985 | [JP] | Japan | 60-264356 |

[51] Int. Cl.[4] ..... B22D 11/18

[52] U.S. Cl. ..... 164/453; 164/454; 164/154; 164/155

[58] Field of Search ..... 164/4.1, 150, 154, 155, 164/413, 414, 451, 452, 453, 454, 455

[56] References Cited

U.S. PATENT DOCUMENTS

| | | | |
|---|---|---|---|
| 3,478,808 | 11/1969 | Adams | 164/454 |
| 3,537,505 | 11/1970 | Thalmann et al. | 164/454 |
| 4,006,633 | 2/1977 | Shipman | 164/451 |
| 4,529,029 | 7/1985 | Block | 164/453 |
| 4,553,604 | 11/1985 | Yaji et al. | 164/452 |
| 4,556,099 | 12/1985 | Yamamoto et al. | 164/150 |

FOREIGN PATENT DOCUMENTS

| | | | |
|---|---|---|---|
| 3423475 | 11/1984 | Fed. Rep. of Germany | 164/452 |
| 55-84259 | 6/1980 | Japan . | |
| 56-7783 | 2/1981 | Japan | 164/454 |
| 57-97856 | 6/1982 | Japan | 164/150 |
| 57-97854 | 6/1982 | Japan | 164/150 |
| 57-115960 | 7/1982 | Japan . | |
| 57-115962 | 7/1982 | Japan . | |
| 57-152356 | 9/1982 | Japan . | |

*Primary Examiner*—Nicholas P. Godici
*Assistant Examiner*—Richard K. Seidel
*Attorney, Agent, or Firm*—Edward W. Greason

[57] ABSTRACT

The present invention quickly and accurately predicts a cast defect during continuous casting, by a sequential temperature-change pattern, and takes and appropriate action in conformity with a position and kind of defect of the cast defect, thereby preventing the cast defect from generating on the casting withdrawn from the mold.

8 Claims, 39 Drawing Sheets

A1 A2 A3 A4 B1 B2 B3
FOURIER COEFFICIENT
(COEFFICIENTS OF RESPECTIVE TERMS)

METHOD AND APPARATUS FOR PREVENTING CAST DEFECTS IN CONTINUOUS CASTING PLANT

This application is a continuation, of application Ser. No. 823,241, filed Jan. 28, 1986 now abandoned.

BACKGROUND OF THE INVENTION

1. Field of the Invention

The present invention relates to a method and an apparatus for preventing cast defects in a continuous casting plant.

2. Description of the Related Arts

As is well known, in continuous casting, molten steel is poured into a mold to form it into a casting having a predetermined cross section, and the casting is then continuously withdrawn from beneath the mold, thereby producing a strand. The continuous casting operation is subjected to a significant influence by the initial solidification of the molten steel within the mold. For instance, if the solidifying shell formed in the mold during the initial solidification stage sticks to the inner surface of mold, or if inclusions are engulfed in the solidifying shell, the solidifying shell will rupture directly beneath the mold and molten steel will flow out. This is known as a Break Out (hereinafter referred to as BO). The BO caused by sticking is referred to herein as "constraint BO", and the BO caused by engulfing inclusions as "engulfing BO".

In addition, if the powder, which is used as a lubricant in the mold, flows nonuniformly on the inner surface of a mold, various defects are formed on the surface of the solidifying shell. The BO and the surface defects formed by the nonuniform flow of powder are hereinafter collectively referred to as cast defects. If a BO occurs, it takes a long time to restore the continuous casting machine to a normal state, and hence productivity is reduced. Also, the formation of surface defects necessitates dressing of the strands, which again incurs a certain amount of plant down-time.

In recent years, there have been rapid advances in an increase in the continuous-casting speed and a direct combination of the continuous casting step with the rolling step. The generation of cast defects in particular is a great hindrance to the implementation of a high speed continuous casting and to the direct rolling, i.e., directly rolling the continuously cast steel sections.

Heretofore, a number of techniques have been proposed to predict or detect cast defects at an early stage, to prevent a BO.

For example, Japanese Unexamined Patent Publication No. 57-152,356 discloses a BO-predicting method in which the average temperature of a mold is detected by a thermocouple embedded within a mold, during a steady casting state, and a BO is predicted by detecting the occurrence of a temperature rise above the average temperature, followed by a fall in the temperature. Japanese Unexamined Patent Publication No. 55-84,259 discloses a method for detecting preliminary phenomena of a BO, in which the temperature values are measured at respective halves of a mold and are compared with one another to obtain the temperature difference therebetween, and this temperature difference is used as an index for detecting a preliminary phenomenon of the BO. Japanese Unexamined Patent Publication No. 57-115960 discloses that an abrupt fall in the temperature below the average temperature is detected by a thermocouple embedded in a mold, and is used for detecting an engulfing of large sized inclusions into the surface of the solidifying shell. Japanese Unexamined Patent Publication No. 57-115962 discloses that the changing rate of the temperature relative to time is detected and then compared with a predetermined range so as to detect anomalies in the solidifying shell.

All of the prior arts disclosed in the above publications involve a fundamental object for predicting a BO. Upon prediction of a BO, usually a lamp, a buzzer, or the like is energized to warn the operators and the operators manually then lower the casting speed based on past experience or in an extreme case, interrupt the casting per se. Accordingly, there is a delay and the time between the time of the BO prediction and the time at which the action by the operator is completed. In this respect, there appears to be room for improvement in the way in which the action of the operator is carried out. As a result, a BO frequently occurs which has been predicted but cannot be timely or effectively prevented. For example, the quality failure in a strand in the form of uneveness or lines due to successive casting, which is caused by a temporary interruption in casting, and a secondary BO, which is caused by malfunctions occurring during the resumption of the casting operation after a casting interruption.

Regarding the controlling of a bath level within the mold during a steady operation period, the casting is carried out to maintain a target level which is measured by a level-detecting device, by which the relationship between the set and measured bath levels is measured during a change thereof, and the pouring nozzle is subjected to feedback control on the basis of the measured relationship, to hold the nozzle-opening at a degree at which the bath level is always maintained within a constant range. When a BO is predicted and the casting speed is to be abruptly decreased, action to abruptly decrease the casting speed is taken, which leads to an abrupt rise in the bath level. Therefore, the above described feedback control cannot prevent problems such as an overflow of molten steel from the mold. The operators must simultaneously implement both the casting speed change and a nozzle-opening control commensurate with the changed casting speed. It is extremely difficult to carry out such simultaneous actions and at the same time maintain the bath level within a predetermined range. A variation in bath level that exceeds a predetermined range is detrimental to the qualities of casting due to the powder engulfing that accompanies such a variation.

SUMMARY OF THE INVENTION

It is a principal object of the present invention to provide a method and apparatus for basically solving the problems of the prior arts, in which the generation of cast defects is promptly and accurately predicted and the cast defects thus appropriately avoided.

It is another object of the present invention to provide an accurate predicting method of formation of the cast defects, for lessening the possibility of a misjudgement, thereby preventing a quality failure in the castings, a temperature fall at the castings, and a failure in the matching between the casting and subsequent steps.

It is a further object of the present invention to provide a method for ensuring that a BO, particularly a constraint BO, is prevented by a minimum of operation actions, thereby preventing the quality failure in the castings, the temperature fall at the castings, and the failure in the matching between the casting and subsequent steps.

In accordance with the objects of the present invention, there is provided a method for avoiding a cast defect in a continuous casting, wherein molten steel is poured into a mold so as to form a casting and the casting is withdrawn from the mold, comprising the steps of: using the mold, in which temperature-detecting terminals are embedded; obtaining a first sequential temperature-change pattern by each of said temperature-detecting terminals; setting second sequential temperature-change patterns, based on a generation of cast defects in continuous casting operations, by each of said temperature-detecting terminals; comparing said first sequential temperature-pattern with said second sequential temperature-patterns; predicting the cast defect when said first sequential temperature pattern conforms to any of said second sequential temperature patterns, and determining a kind of a cast defect and a position of a cast defect corresponding to an embedded position of or a region between the temperature-detecting terminals by said prediction; setting casting speed-changing patterns, each of which enable prevention of the cast defect from generating on the casting withdrawn from the mold, depending upon a respective kind and position of the cast defect; selecting one of said casting speed-changing patterns so as to enable prevention of said predicted cast defect being withdrawn from the mold; and, changing the casting speed based on the selected one pattern.

According to an embodiment of the present invention, the second sequential temperature-change pattern is quantitatively determined by Fourier-transforming the sequential-temperature change pattern for casting operations, in which the cast defects are generated in past, so as to obtain coefficients of respective terms of Fourier series, and then determining a correlationship between said coefficients of respective terms and the generation of a cast defect so as to preset power coefficients of the respective terms, in which the cast defect is generated, and the first sequential temperature change-pattern is quantitatively determined by Fourier-transforming the temperature values detected by said temperature-detecting terminals, so as to obtain coefficients of respective terms of the Fourier series, and, when these coefficients fall within said preset power coefficients of respective terms, the prediction of the cast defect is made with regard to said kind and position.

According to another embodiment, the mold, which comprises mold walls forming four corners at adjoining parts thereof, includes at said corners said temperature-detecting terminals located at an essentially identical level along a mold height, thereby allowing detection of temperature values at the corners, obtain temperature differences $\Delta T_1$ and $\Delta T_2$ between two pairs of opposite corners, and calculate a difference $\delta$ between said $\Delta T_1$ and $\Delta T_2$, and the prediction of a cast defect is performed by a comparison the second sequential temperature-pattern which represents past casting circumstances in which the cast defect is generated in the form of a corner surface crack, with the first sequential temperature change-pattern which represents a casting circumstance at an instant casting, the past casting circumstances are quantitatively determined by obtaining a correlationship between said $\delta$ and said corner surface crack, so as to determine a power at which said corner surface crack is generated, and, further, and when said difference $\delta$, which is sequentially calculated during continuous casting, falls within said power indicating the corner surface crack, the prediction of a cast defect is made with regard to said kind and position.

According to a further embodiment, the temperature-detecting terminals comprise a plurality of terminals arranged in the moving direction of the casting, and, said cast defect is a break out caused by engulfing of an inclusion into a solidifying shell which is being formed on an outer surface of the casting within the mold, and said second sequential temperature-change pattern comprises successive shifts of the temperature values detected by said temperature-detecting terminals, which shifts occur successively in time at the at least two temperature-detecting terminals arranged in the moving direction of the casting and cause a temperature fall from a steady level in which the cast defect does not form on the casting withdrawn from the continuous casting mold, to a low level, and the prediction of the engulfing break out is made when the first sequential temperature-change pattern conforms to the second sequential temperature-change pattern.

According to a still another embodiment, the mold is oscillated periodically with cycles including a negative stripping time, in which the mold lowers at a speed greater than the withdrawal speed of the casting, and said cast defect is a rupture caused by constraining, on an inner surface of the mold, of a part of a solidifying shell which is being formed on an outer surface of the casting within the mold, and, further a correlationship between the negative stripping time and a growth speed of the solidifying shell is predetermined, and a requisite minimum thickness of the solidifying shell required is set depending upon a generating level of said rupture along a mold height so as to enable repair of said rupture, and, when the constraint rupture is predicted by the sequential temperature-change pattern, the casting speed is changed, at its changing step, to attain the negative stripping time which allow the solidifying shell to grow, at its rupturing part, to said requisite minimum thickness and repair the solidifying shell within said mold.

An apparatus for preventing a cast defect in a continuous casting plant according to the present invention comprises: a plurality of temperature-detecting terminals embedded in a continuous casting mold along a casting direction (x) and a direction of its width (y) each temperature-detecting terminal enabling to obtain a sequential temperature-change pattern; a predicting unit of a casting defect generating within said continuous casting mold, said unit enabling a prediction of a position and kind of the cast defect, using the sequential temperature-change pattern and generation of signal of the kind of cast defect and a signal of the position of cast defect; a unit for setting casting speed which sets, based on said signals and operating conditions input thereto, a casting speed by which the cast defect is prevented from being formed on a casting withdrawn from the continuous casting mold; a casting speed controlling unit, to which an instruction signal of the casting speed is input from the casting speed setting unit; and, a setting unit for controlling the opening degree of a nozzle for pouring molten steel in the continuous casting mold, which unit controls the flow rate of molten steel from the nozzle based on the changed casting-speed. In addition, a rate at which molten steel is poured into the continuous casting mold may be controlled simultaneously with the control of the casting speed.

BRIEF DESCRIPTION OF THE DRAWINGS

FIGS. 15 through 17 illustrate an embodiment according to the present invention: in which FIG. 15 shows an elevational view of the mold; FIG. 17 shows the coefficient of respective terms obtained by Fourier transformation of the temperature detected on the time sequence shown in FIGS. 16(A) and (B);

FIGS. 21 through 23 illustrate an embodiment according to the present invention: in which FIG. 21 shows a cross sectional view of a mold in which the temperature sensors are embedded; FIG. 22 is a graph showing the power coefficients of defects-generation; and FIG. 23 is a graph showing the sequential change of temperature difference $\delta$;

DESCRIPTION OF THE PREFERRED EMBODIMENTS

Figure 1:
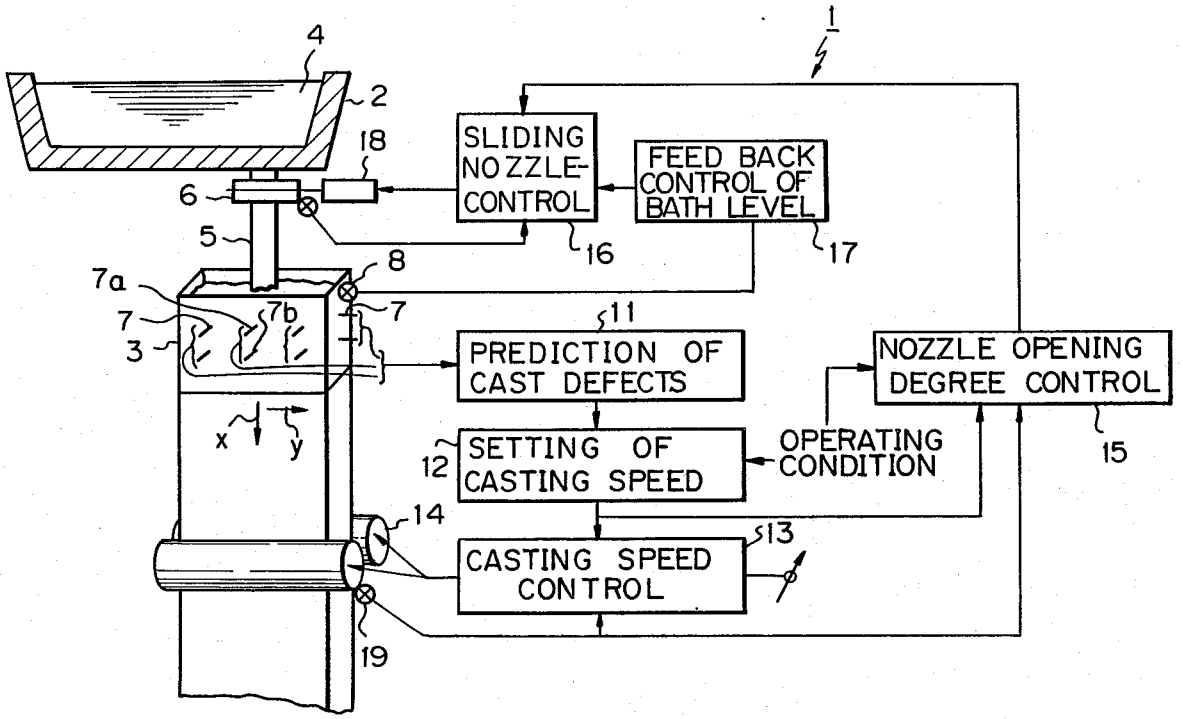
FIG. 1 is an overall block diagram illustrating an example of the apparatus for preventing cast defects according to the present invention.

Referring to FIG. 1, an overall views of an example of the device for preventing cast defects according to the present invention is shown by a block diagram. A tundish is denoted by 2, and a mold is denoted by 3. The molten steel 4 is stored in the tundish 2 and then poured through a pouring nozzle 5 into the mold 3. The pouring nozzle 5 is equipped with a sliding nozzle 6, which is generally known as a device for controlling the flow rate of molten steel. The flow rate of molten steel poured into the mold 3 is controlled by adjusting the opening degree of the sliding nozzle 6. The mold 3 is provided with a plurality of temperature-detecting terminals 7 embedded in the mold 3 along the casting direction x and along the direction of the width of a casting y. A level detector 8 is disposed on or above the mold 3, so as to detect the bath level in the mold 8.

A predictor 11 for the cast defects has a construction such that the temperature values detected by the temperature-detecting terminals 7 are constantly input therein. The predictor 11 for the cast defects (hereinafter simply referred to as the predictor 11) generates a sequential temperature-change pattern of the detected temperature values in a time sequence. This sequential temperature-change pattern is used for predicting what kinds of and where cast defects are formed.

Figure 2B:
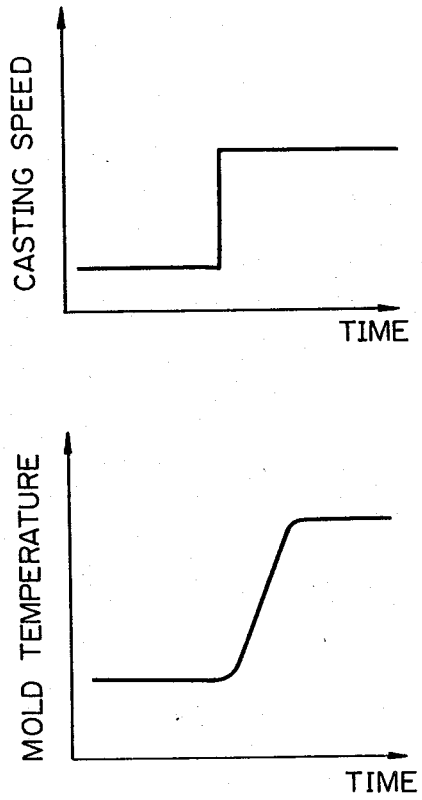
FIGS. 2(A) and (B) show at the upper part usual changes in the casting speed, and at the lower part, temperature changes in the mold in conformity with the casting speed changes.
Figure 2A:
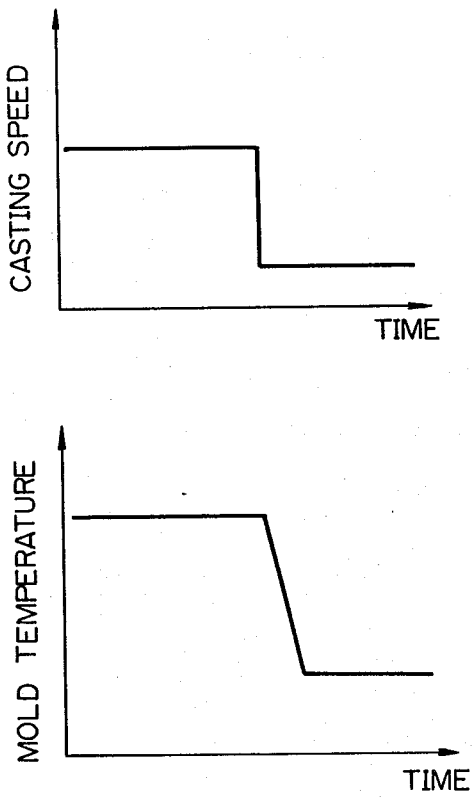

Note, numerous proposals for predicting or detecting cast defects have heretofore been made, as described above. In these proposals, however, the absolute value of temperature detected by temperature-detecting terminals, such as thermocouples, are utilized, as is, for the prediction or detection. In addition, in these proposals, the temperature is detected at one position in the casting direction, and an absolute value of the detected temperature is used as a criterion which is compared with the average temperature in a steady state, or the temperature at the opposite mold wall as described above. Furthermore, the degree of rising or falling of the temperature is calculated by using the detected temperature values, and then compared with the predetermined range of such a degree. Nevertheless, there is usually a great dispersion, depending upon the kinds of cast defects and prevailing circumstance, in the quantity of temperature-rise or fall upon the generation of cast defects and its change per unit of time. In extreme cases, the temperature-change patterns greatly vary even where identical cast defects are generated. The temperature-change pattern when the cast defects are generated has, therefore, a complicated characteristic, and thus by the previous proposals, an accurate detection of the cast defects cannot be expected. As described hereinabove, the temperature values in a mold change not only when the cast defects are generated but also when the casting speed or the bath level in a mold abruptly varies. Referring to FIGS. 2(A) and (B) showing the change in casting speed and incidental temperature change, an abrupt decrease in the casting speed occurs in FIG. 2(A) and an abrupt increase in the casting speed occurs in FIG. 2(B). As is understood from FIGS. 2(A) and (B), when the detection is carried out by using an absolute value of the temperature, and by means of any of the previous proposals, the variation incident to operation, such as the change in casting speed and the bath level is recognized as cast detects, and a misjudgement occurs, to generate an alarm. It is a conventional practice during operation, when the occurrence of cast defects is detected, to interrupt the casting operation, or to continue the casting operation while taking action to extremely lower the casting speed. Accordingly, if an erroneous alarm is frequently generated, various problems arise. For example, quality failure such as unevenness on a casting occur, production of high temperature strands necessary for direct rolling becomes difficult, and the matching of the casting step with the subsequent steps is seriously and adversely influenced.

In order to provide a method for predicting or detecting cast defects, applicable in practice, the present inventors repeated studies for the sequential temperature-change pattern obtained by the temperature-detecting terminals 7 and thus discovered an accurate and prompt method for predicting cast detects. The discovered method resides in that the temperature values are detected in time-series by the temperature-detecting terminals and are Fourier transformed, and the coefficients of the respective terms of the Fourier series are compared with predetermined coefficients of the respective terms of the Fourier series obtained in the casting operations in the past where cast defects have occurred. This method is now described in more detail.

In a constraint BO, a part of the solidifying shell sticks to the mold wall and ruptures, within a mold, and the ruptured part breaks out when withdrawn from the mold. A method for detecting the constraint BO is now described.

Figure 3:
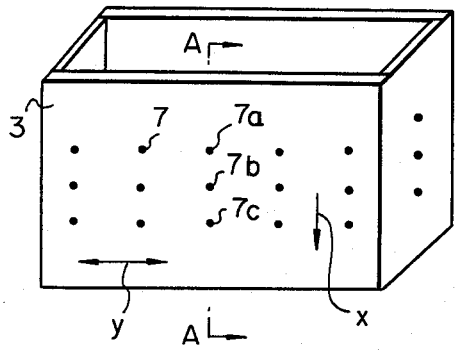
FIG. 3 is a side elevational view of an example of the mold used in the present invention.
Figure 4:
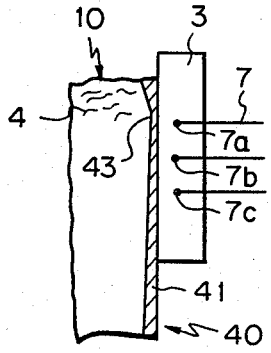
FIG. 4 is a cross sectional view taken along the line A—A of FIG. 3.
Figure 5:
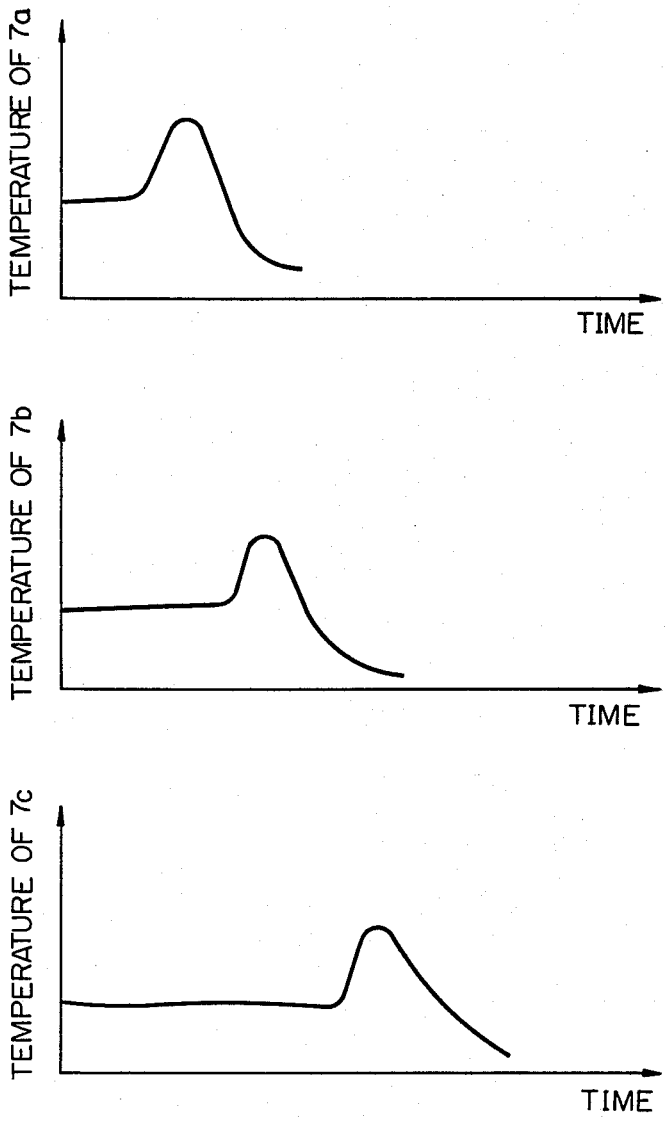
FIG. 5 shows the temperature-change patterns when a constraint BO is generated.

The temperature-detecting terminals 7 are arranged in the mold 3, for example, as shown in FIG. 3. A plurality of the temperature-detecting terminals 7 are embedded in the mold 3 and are arranged as a plurality of rows in the wide side and a single row in the narrow side thereof. In FIG. 4, which is a cross section taken along the line A—A shown in FIG. 3, the molten steel is denoted by 4 and the solidifying shell of a casting 40 is denoted by 41. If a part of solidifying shell 41 sticks on the mold 3, the solidifying shell 41 ruptures directly beneath the stuck part 43, due to withdrawal force of the casting 40, and the molten steel 4 then flows out. The temperature value detected by the temperature-detecting terminals 7 rises once, as shown in FIG. 5, when the ruptured part passes any one of the temperature-detecting terminals 7. After the ruptured part has passed, the detected temperature falls, since the stuck solidifying shell 41 does not move or descend and hence grows. Such a temperature-rise and fall is heretofore known in the circumstance where a constraint BO will be generated. Such a temperature-rise and fall however also occur when the level of a bath is abruptly lowered in the mold. The present inventors tried to discover a pattern of sequential temperature change which is not influenced by the variable factors of the operating conditions and which is peculiar to only the constraint BO. As a result of a mathematical and statistical analysis, it was discovered that there is a close correlationship between the coefficients of the respective terms of a Fourier series, which are obtained by transforming the temperature values detected in time series, and a circumstance at which the constraint BO is generated.

Now, a method is described for Fourier transforming the temperature-values detected in the time series and obtained the coefficients of respective terms of the Fourier series, with regard to the fast Fourier transformation.

The temperature is measured by the temperature-detecting terminals 7 in FIG. 3 at every period. This temperature is expressed as T(k) at the k-th period of the n time-series (k=0, 1, 2, . . . n−1). An example of the Fourier transformation of T(k) is given in formula (1) with sine and cosine expansion.

$$T(j) = (A_0/2) + \sum_{k=1}^{\frac{n}{2}-1} [Ak \cdot \cos\{(2\pi k/n) \cdot j\} + Bk \cdot \sin\{(2\pi k/n)\}j] + (Ak_0/2) \cdot \cos\pi j \quad (1)$$

T(j): Fourier series of T(k)
$A_0$: Fourier Coefficient
Ak: Fourier Coefficient
Bk: Fourier Coefficient
$Ak_0$: Fourier Coefficient
k: Integer
$k_0$: Integer ($k_0$=n/2)
n: Integer (Number of data and even number)
j: Integer
$\pi$: Ratio of circumference of a circle to its diameter The coefficient Ak of the cosine term and the coefficient Bk of the sine term in the formula (1) are expressed as A(j) and B(j), respectively. A(j) and B(j) have the following formulas (2) and (3), respectively.

$$A(j) = (2/n) \cdot \sum_{m=0}^{n-1} T(m)\cos(2\pi jm/n) \quad (2)$$

n: Integer (Number of data and even number)

$$(0 \leqq j \leqq n/2) \quad (3)$$

$$B(j) = (2/n) \cdot \sum_{m=0}^{n-1} T(m)\sin(2\pi jm/n)$$

$$[1 \leqq j \leqq (n/2) - 1]$$

n: Integer (Number of data and even number)
m: Integer (Number of data and even number)
T(m): temperature value detected The coefficients of the respective terms obtained by Fourier transformation, herein, are A(j) and B(j) expressed by the formulas (2) and (3), respectively. Alternatively, instead of the sine and cosine, coefficients may be expressed by a real part and an imaginary part, respectively.

Figure 6:
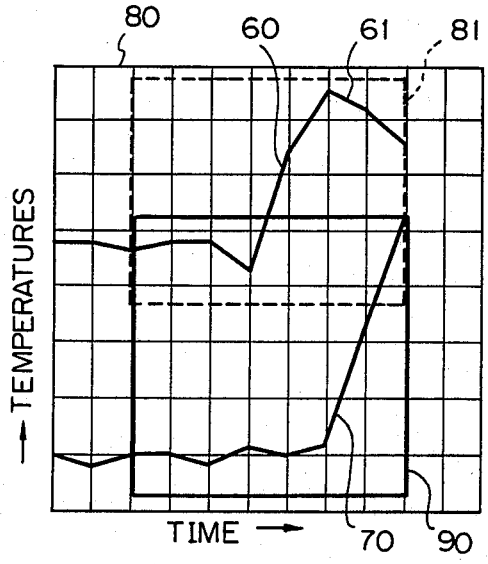
FIG. 6 is a graph showing the time- and temperature-range in which the temperature detected in the time sequence is Fourier converted.

During the casting operations wherein the constraint BO was generated, the temperature values were detected by the temperature-detecting terminals *7a*, *7b* in the time-series, and Fourier-transformed, and then the correlationship between the constraint BO and the coefficients of the respective terms was investigated. An example is described with reference to FIG. 6. Referring to FIG. 6, the time-sequential change of temperature detected is shown. For a Fourier transformation of such a change, it is divided into appropriate intervals of time, and at only one time interval is such a change Fourier transformed. The temperature detected, in time series, by the temperature-detecting terminal *7a* is denoted by 60. The temperature value detected by the temperature-detecting terminal *7a* with a time delay, i.e., an interval next to that of the temperature 60, is denoted by 61. The temperature detected, in time series, by the temperature-detecting terminal *7a* is denoted by 70. The intervals, in which the detected temperature in the time-series 60 and 61 are Fourier transformed, are denoted by 80 and 81, respectively. The interval, in which the detected temperature-values 70 in the time series is Fourier-transformed, is denoted by 90. An example, in which eight bits of data are used for each respective interval, is described hereinafter. Since the number of bits of data is eight, there are four cosine coefficients A(j) and three sine coefficients B(j) according to j=n/2 (in formula (2)) and j=(n/2)−1 (in formula (3)), respectively. A total of seven coefficients are shown in FIG. 7.

$A_0$ at j=0, according to formula (1), is $$A_0 \text{ at } j = 0, \text{ according to formula (1), is}$$

$$A_0 = (2/n) \cdot \sum_{m=0}^{n-1} T(m).$$

That is, $A_0$ is related to an average value of the absolute temperature values detected. Not all average values can be utilized as a parameter for recognizing the pattern of temperature change in time series. In addition, $A_0$ greatly varies depending upon thickness of a mold and the like. The values of $A_0$ were not, therefore, obtained in the example now described, and are not shown in FIG. 7.

Figures 7A, 7B, 7C:
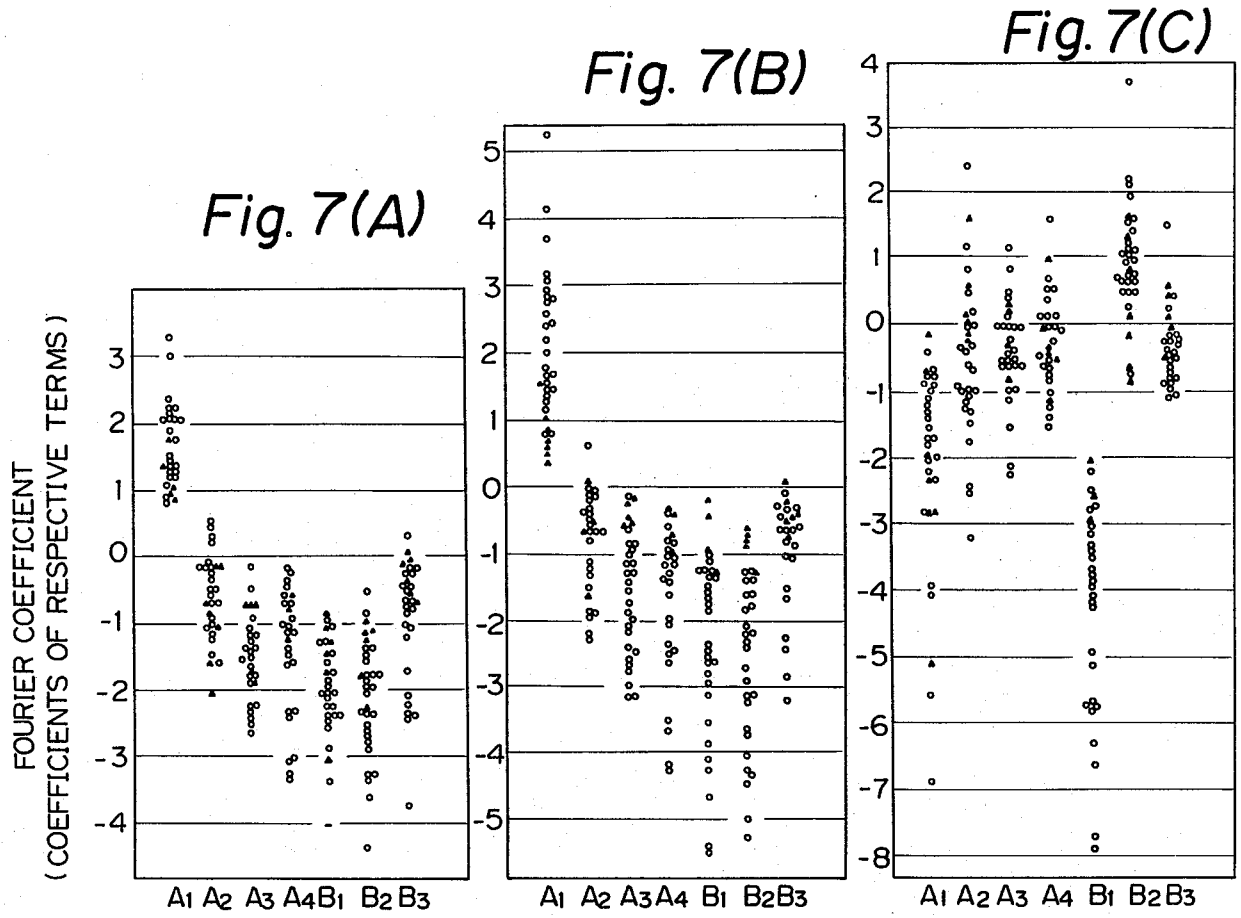
FIGS. 7(A), (B), and (C) are graphs showing the coefficients of respective terms of the formula indicating the generation of a constraint BO, obtained in accordance with an example of the present invention. The coefficients are expressed as a power of "e" (natural logarithm) (hereinafter simply referred to as the power coefficients)

The coefficients of the respective terms of Fourier series were obtained by transforming the detected temperature values in time series, with regard to the casting operations with a constraint BO in the past, as described above, and are given in FIG. 7. FIGS. 7(A), (B), and (C) correspond to the intervals 80, 90, and 81, respectively, and shown in the abscissa are the coefficients of the respective terms and in the ordinate, these are shown as power coefficients. As is apparent from FIG. 7, where the constraint BO occurs, the coefficients of the respective terms have a virtually constant pattern and disperse within a certain range. Such a pattern varies depending upon the positions at which the temperature-detecting terminals are embedded, and the interval of the Fourier transformation, but is peculiar to the occurrence of the constraint BO.

In past casting operations where the constraint BO is generated, the temperature values detected in time-series is Fourier transformed, the range in variance of the respective terms of the Fourier series is determined, and the upper and lower limits of the range determined is defined herein as the power coefficient which indicates the generation of cast defects and which can unequivocally identify a complicated temperature pattern of the cast-defect generation. The coefficients of the respective terms in a given actual continuous casting operation are obtained by Fourier transformation of the temperature values detected in time-series and then compared with the power coefficients indicating the generation of cast defects. When all of the coefficients of the respective terms during continuous casting are compared with the power coefficients indicating the generation of cast defects, and the comparison result is such that all of the former coefficients fall within the latter, an extremely high probability that the cast defect will be generated is indicated, and hence, a casting anomaly is detected.

As is described above, the coefficients of respective terms have values which depend upon the positions at which the temperature-detecting terminals are embedded and on the interval of Fourier transformation, but exhibit values peculiar to BO. Accordingly, a casting anomaly can be detected by comparison of the coefficients of respective terms with regard to temperature values detected by any of the temperature-detecting terminals 7*a* and within any of the intervals 80, 81 for Fourier transformation.

As shown in FIG. 3, each row of temperature-detecting terminals comprises two or more terminals 7 and the power coefficients for each terminal indicating the generation of cast defects are established. When the casting anomaly is detected based on a criterion that at each temperature-detecting terminal the coefficients of respective terms measured fall within the range of power coefficients indicating the generation of cast defects, a highly accurate detection of the cast defects becomes possible. The accuracy is further enhanced by setting an additional interval 81 of Fourier transformation with a time-delay, and detecting a casting anomaly when the temperature fall occurs with a time delay.

The length of the intervals for Fourier transforming the temperature values detected in the time-series, as well as the number of temperature values detected in one interval, can be optionally determined by the kinds and generation frequency of the cast defects, and by the various operation conditions. According to an example, eight values are detected in a 24 second interval.

The intervals for Fourier transformation may be continuously set with a time delay, so as to detect, in each interval, the temperature which varies at each moment, and to calculate the coefficients of respective terms at each moment. Such continuous calculation and resulting calculation-load can be avoided by a calculation method for a selected period of the temperature change whereby, when the detected temperature value starts to rise above or fall below an ordinary average temperature. This rise or fall of the temperature value is detected by a simple logic, such as a conventional deviation method, and, then the temperature-rise or fall is utilized to trigger the setting of the intervals and the Fourier transformation.

A temperature-detecting terminal 7 is preferably embedded in a mold at a position below the molten-steel level 10, particularly 100 mm or more below the molten-steel level 10, since variance in the molten-steel level 10 has little influence upon the mold-temperature, and hence, it can be easily measured with a high accuracy. The distance between the temperature-detecting terminals 7 in a vertical direction is preferably 50 mm or more, since the movement of a ruptured part of the solidifying shell can be correctly detected by pairs of temperature-detecting terminals at such a distance.

Figure 8:
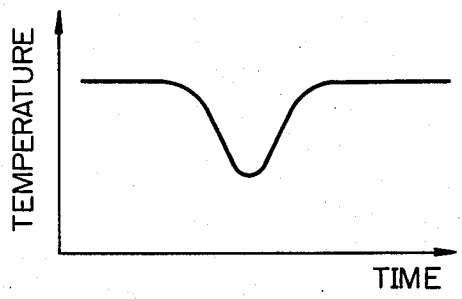
FIG. 8 shows a typical temperature-change pattern when an engulfing BO is generated.
Figure 9:
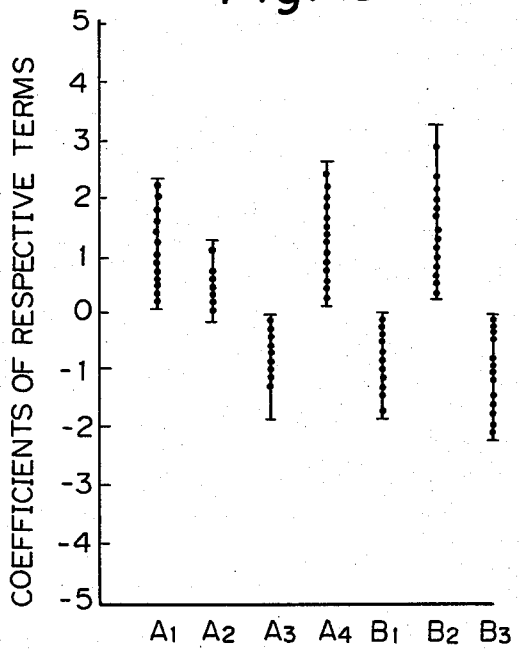
FIG. 9 is a graph showing the power coefficients of the formula indicating the generation of a constraint BO, obtained in accordance with an example of the present invention.

The correlationship between the coefficients of the respective terms and the engulfing BO is now described. In the engulfing BO, in which large-sized inclusions are engulfed in the solidifying shell 41 within a mold and the BO starts at the inclusion-engulfing part of the solidifying shell during the withdrawal of a casting, the temperature variance is usually as shown in FIG. 8. FIG. 9 illustrates, as in the case of FIGS. 7(A) through 7(C) for the constraint BO, an example of the results of an investigation into the continuous casting in which the engulfing BO was generated in the past. In the investigation, the temperature values detected in time-series are Fourier transformed and the coefficients of the respective terms, as well as the power coefficients indicating the generation of cast defects, are obtained. It is verified, as in the case of the constraint BO, that there is a close correlationship between the engulfing BO and the coefficients of the respective terms.

Figure 10:
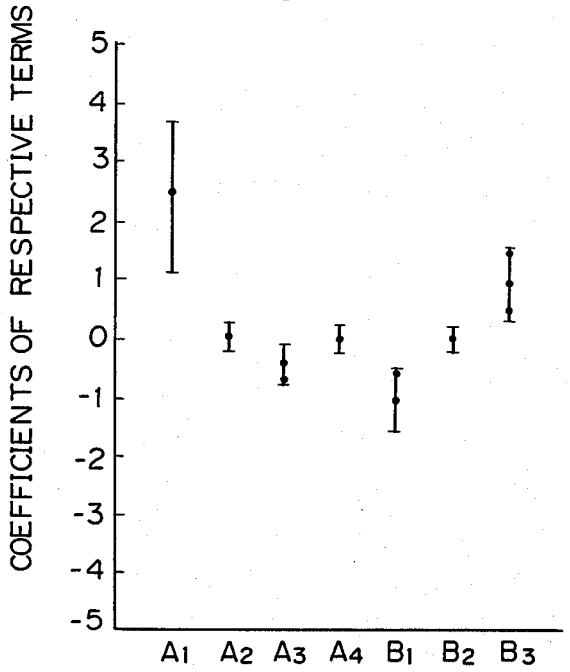
FIG. 10 is a graph showing the power coefficients of the formula indicating the generation of longitudinal cracks, obtained in accordance with an example of the present invention.
Figure 11:
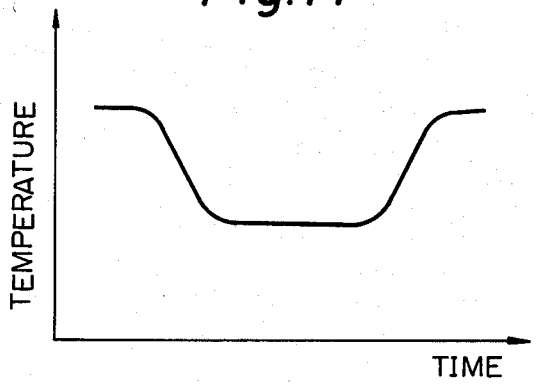
FIG. 11 shows the temperature-change patterns when longitudinal cracks are generated.

FIG. 10 shows the power coefficient of the respective terms obtained by Fourier transforming the temperatures values detected in time series for the continuous casting in which longitudinal cracks were generated in the past. Referring to FIG. 11, a representative varying temperature pattern is illustrated for such a continuous casting.

Figure 12:
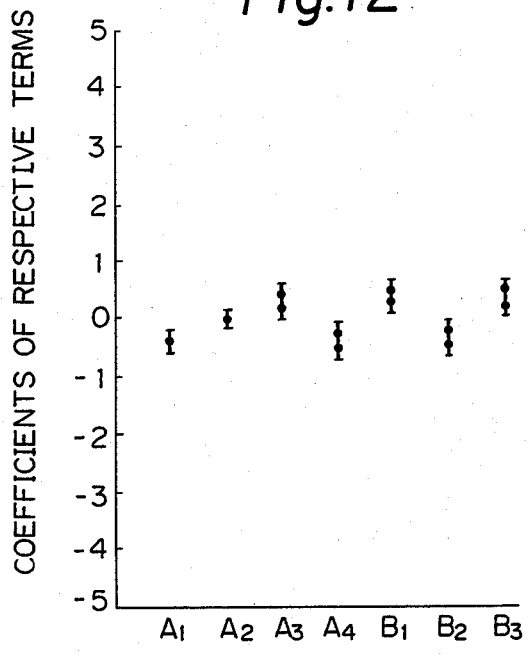
FIG. 12 is a graph showing an example of the results in which the power coefficients indicating generation of the cast-defect were obtained when a wrinkle is generated.
Figure 13:
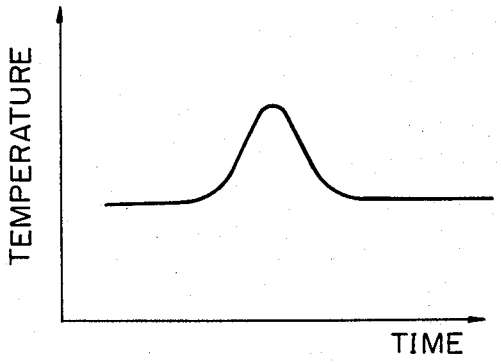
FIG. 13 shows a representative temperature-change pattern when wrinkles are generated.

FIG. 12 shows the coefficient of the respective terms obtained by Fourier transforming the temperatures detected in time series for the continuous casting in which wrinkles were generated due to a non-uniform flow of the powder in the past. Referring to FIG. 12, a representative varying temperature pattern is illustrated for such a continuous casting.

It is verified, as in the case of constraint and engulfing BOs, that there is a close correlationship between such surface defects as longitudinal cracks and wrinkles and the coefficients of the respective terms.

Accordingly, the method for detecting the generation and kind of a cast defect in accordance with the present invention resides in that power coefficients indicating the generation of a cast defect are preliminarily determined for the respective kinds of casting defects, the temperature is detected and measured in an actual continuous casting in the time series, and then Fourier transformed to obtain the coefficients of respective terms, and then are compared with the preliminarily determined power coefficients indicating the generation of a cast defect. The accuracy of the power coefficients indicating the generation of a cast defect can be enhanced by using the upper and lower limits thereof, so that any temperature pattern falling within the upper and lower limits are determined to be that in which a cast defect is generated. By enhancing the accuracy of the upper and lower limits, accuracy of the criterion for determining the generation of a cast defect can be enhanced.

Figure 14:
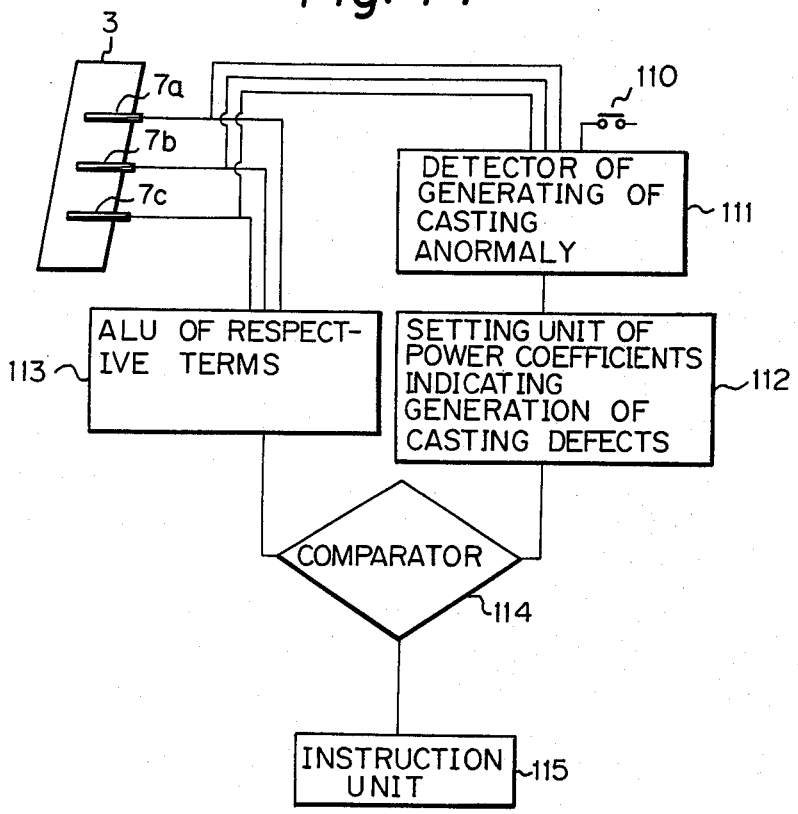
FIG. 14 is a block diagram showing a specific example for judging the generation of anomalies in accordance with the present invention.

Referring to FIG. 14, a specific method for determining the occurrence of an anomaly in accordance with the present invention is illustrated by way of a block diagram which corresponds to the predictor 11 shown in FIG. 11. The temperature values detected by the temperature-detecting terminals 7*a*–7*c* embedded in the mold 3 are input to the device 111 for detecting the generation of a casting anomaly and the calculator 113 of the respective terms. When the cast defects, such as BO or surface defects, are found by an operator, an alarm is produced by an instruction device 110, in the form of a switch, so that the device 111 is actuated to receive the temperature values detected by the temperature-detecting terminals 7. The device 111 then activates the unit 112 which sets the power coefficients indicating the generation of the cast defect. In this unit, the temperature values detected in time series are Fourier transformed and the kinds of cast defects are distinguished. Also, the power coefficients indicating the generation of cast defects are calculated. In the unit 112, the power coefficients indicating the generation of cast defects are calculated and are stored as the data indicating respective cast defects for the continuous casting in the past.

On the other hand, the temperature values detected by *7a–7c* in time series are input, during the continuous casting operation, to the arithmetic logic unit 113 of the respective terms, in which the coefficients of respective terms are calculated for each moment. The calculation results are input to the comparator 114, to which the power coefficients indicating the generation of cast defects are also input from the device 112. The so input coefficients of the respective terms varying during the continuous casting operation and the set power coefficients indicating the generation of cast defects are compared in the comparator 114. When all coefficients of the respective terms input from the arithmetic logic unit 113 fall within the ranges of the power coefficients indicating the generation of cast defects, the instruction unit 115 is actuated to generate an alarm.

[First Example]

Figure 15:
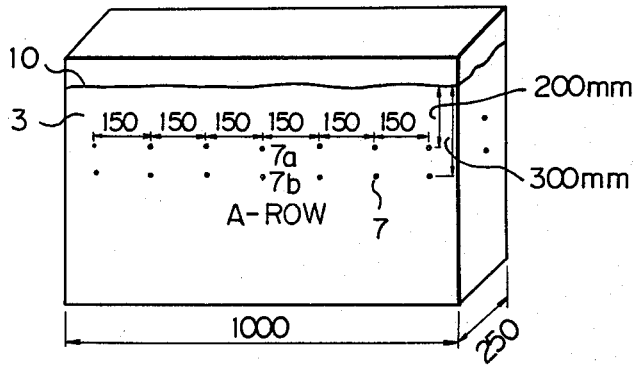
Figure 16A:
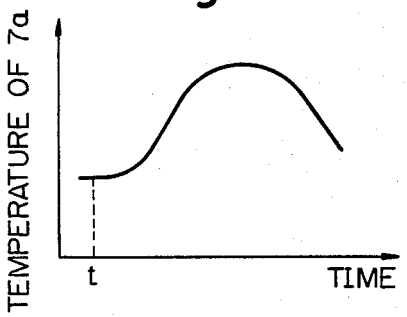
FIGS. 16(A) and (B) show temperature change-patterns.
Figure 16B:
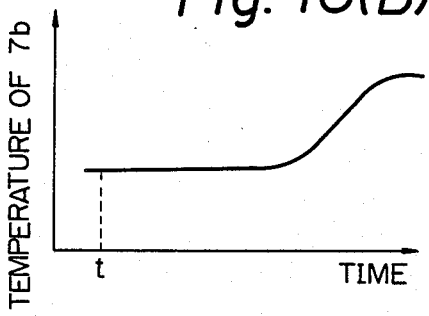
Figure 17A:
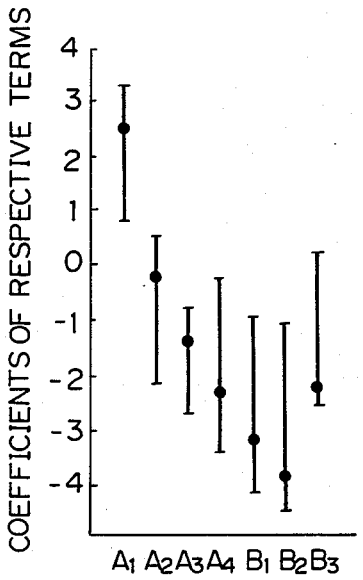
Figure 17B:
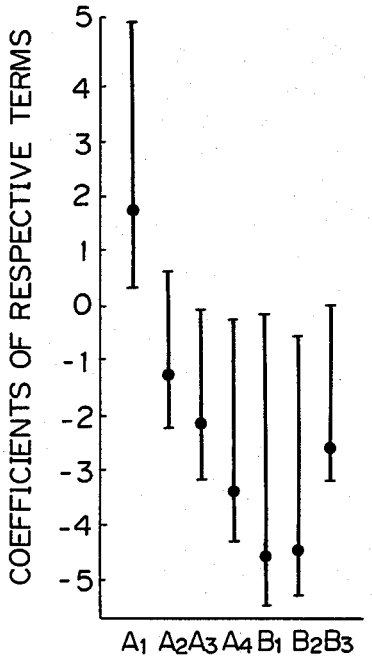

The present invention was implemented in a continuous casting of low carbon, Al-killed steel into a casting 250 mm thick and 1000 mm wide. FIG. 15 illustrates the mold and the embedding position of temperature-detecting terminals 7 in the present example. The temperature-detecting terminals 7 were thermocouples and were embedded in the mold 3 so that their front ends were located 15 mm away from the inner surface of mold 3. The temperature values detected by the temperature-detecting terminals *7a* and *7b* located along the "A"-row on the wide side of the mold varied as shown in FIGS. 16(A) and (B), respectively, during the casting at a casting speed of 1.6 m/min. These temperature values were Fourier transformed to obtain the power coefficients of the respective terms as shown in FIGS. 17(A) and (B). These coefficients fell within predetermined power coefficients indicating the generation of cast defects, and, hence, the presence of an anomaly due to a constraint BO was determined. The casting speed was lowered to 0.2 m/min and this casting speed was maintained for 30 seconds. As a result, the generation of BO was completely prevented.

Figure 18:
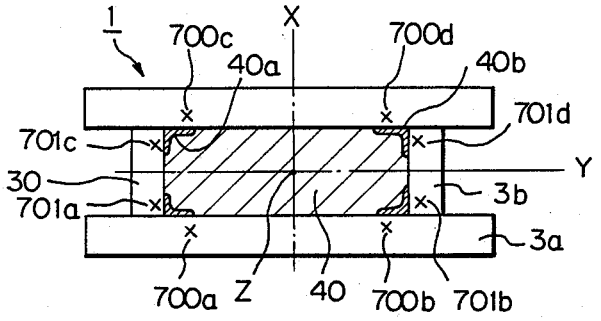
FIG. 18 is a cross sectional view of a well known mold, in which the temperature-detecting terminals are disposed on all sides.

Next, a method for presuming a surface defect on the corners of a casting is described. A surface defect on the corners of a casting is known to be generated when, for example, the lubricant used at an initial casting stage for lubricating the mold flows non-uniformly into the mold. Although such a non-uniform flow causes various cast defects to be formed, the defects are concentrated at the corner of a casting. Such a defect on the corner of a casting may lead to a BO. This is believed to occur because of the delay in solidification at a part of the corners and incidental stress concentration. The solidification delay and its incidental stress concentration are influenced by various factors, such as the temperature of molten steel poured into a mold, the taper quantity of the narrow sides of a mold, the condition for the flow of and lubrication by the powder, and the casting speed. Accordingly, in the investigations by the present inventors, for the correlationship between the generation of cast defects in actual operations in the past and the sequential temperature change of a mold, the mold was equipped, as shown in FIG. 18, with the temperature-detecting terminals, i.e., thermo-couples, 700*a*–700*d*, 701*a*–701*a*, embedded therein at locations corresponding to the corners 40*a* of a casting 40 which was formed by the mold walls 30 constituted in turn by the wide sides 3*a* and narrow sides 3*b*.

Figure 19:
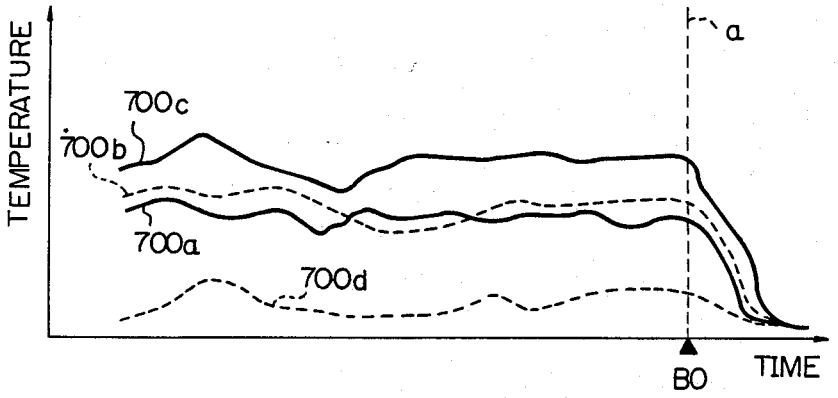
FIG. 19 is a graph showing the temperature sequences obtained by all of the temperature-detecting terminals shown in FIG. 18.
Figure 20:
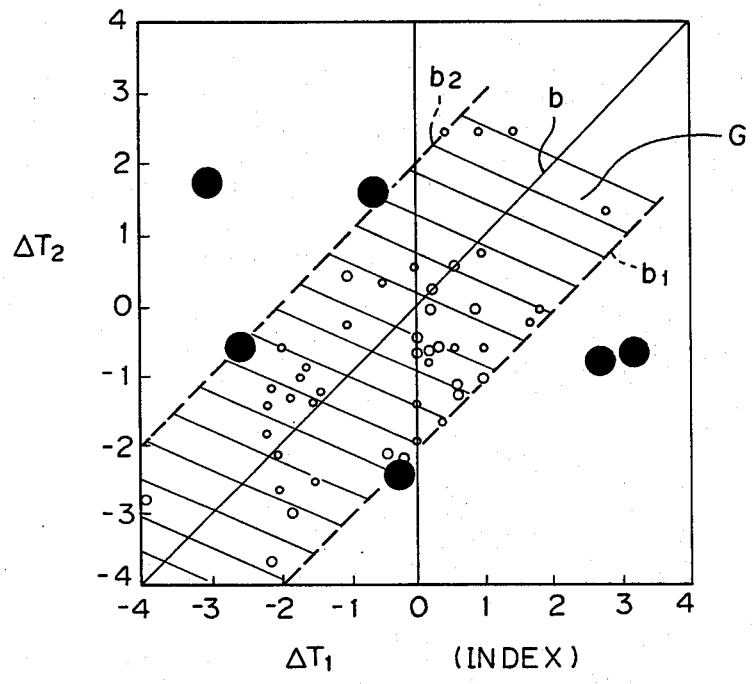
FIG. 20 is a graph showing the power coefficient obtained in accordance with the present invention.

Referring to FIG. 19, the temperature value measured by the temperature-detecting terminals 700*a*–700*d* embedded in the wide side 3*a* are shown, as measured. The BO due to surface cracks generated at the time are shown by a broken line "a". As is apparent from FIG. 19, since the change in temperature values detected was small even during the BO generation, the BO generated due to such as surface defects and incidental stress could not be detected by a conventional method in which the individual temperature values measured are monitored to detect a deviation from a steady level to a low level. However, it was discovered that a great deviation in temperature values exists between 700*a* and 700*b*, and also between 700*c* and 700*d*; that is one pair of the temperature values was detected at 700*a* and 700*b* and another pair detected at 700*c* and 700*d*, these pairs being formed by the temperatures detected at pairs straddling the axis X (FIG. 18) along the narrow sides 3*b*. The present inventors noticed this discovery and investigated a correlationship between the BO generated due to a surface defect and the inter-corner temperature differences between the two pairs of corners, each pair being formed by the corners separated by the axis X along the short sides 3*b*. Referring to FIG. 20, an example of the investigation results is illustrated for the continuous casting in which the BOs due to surface defects was generated in the past. The abscissa indicates $\Delta T_1$, which is a temperature difference at 700*a* and 700*b* ($\Delta T_1 = T_{700a} - T_{700b}$), and the ordinate indicates $\Delta T_2$, which is temperature difference at 700*c* and 700*d* ($\Delta T_2 = T_{700c} - T_{700d}$). The $\Delta T_1$ and $\Delta T_2$ are shown numerically by an index which is obtained by multiplying the actual value by an indicating coefficient. The o and • symbols in FIG. 20 designate the normal castings free of cast defects and the castings, in which the BOs due to surface cracks are generated, respectively. The linear line b indicates $\Delta T_1 = \Delta T_2$, that is, a zero difference in the inter-corner temperature at the two pairs of corners. When $\Delta T_1 = \Delta T_2$, no cast defects were generated at all. However, when the difference $\delta = \Delta T_1 - \Delta T_2$ is $-2$ or less or 2 or more, BOs due to surface defects are frequently generated. The linear lines $b_1$ and $b_2$ indicate $\delta = 2$ and $\delta = -2$, respectively. Within the hatched region G, the production of castings free of defects was possible, but outside the hatched region, the BOs due to surface defects were generated at a high ratio. The region outside the hatched region G is defined herein as the power coefficient for generating the surface defects of a casting (hereinafter simply referred to a the defect-generating power coefficient). The defect-generating power coefficient is preliminarily determined by such operating conditions as a casting size, steel grade, temperature of molten steel in a mold, a taper quantity of the narrow sides of a mold, and the kind and quantity of powder to be used. When a defect-generating power coefficient is preliminarily determined, then the temperature values are detected by the temperature-detecting terminals embedded in the mold corners, and the temperature differences $\Delta T_1$, $\Delta T_2$ mentioned above are obtained, and the difference $\delta$ is calculated and compared with the defect-generating power coefficient.

When the difference δ falls within the defect-generating power coefficient, detection of a surface defect is determined.

The temperature of mold walls can be directly measured by thermocouples as described above. However, instead of the temperature-detecting terminals directly measuring the temperature as above, a well known heat-flow meter for measuring the heat flux using a quantity of heat across a unit area of a mold wall can be used as the temperature-detecting terminal. Such a heat-flow meter can accurately detect the initial solidification condition in a mold, without being influenced by variation in the absolute temperature of the mold walls due to a change in the thickness of the mold walls and the temperature of cooling water.

The temperature-detecting terminals can be embedded in either the wide or narrow sides of the mold walls, provided that the embedding position corresponds to the corners 40*a* of a casting 40. When the temperature-detecting terminals are embedded in the narrow sides, the differences in the temperature values $\Delta T_1$ and $\Delta T_2$ are defined such that $\Delta T_1 = T_{700a} - T_{700c}$, and $\Delta T_2 = T_{700b} - T_{700d}$, that is the differences at both sides of the axis Y along the long sides are calculated. When obtaining $\Delta T_1$ and $\Delta T_2$ of the axis X and Y, the defect-generating-power coefficient is useful as the criterion for determining the BO caused by surface defects.

The present inventors found that a distance of a temperature-detecting terminal from the corner 40*b* of a casting 40, which distance is effective for obtaining the criterion mentioned above, is approximately 150 mm or less for the terminal embedded in the wide sides 3*a* and is approximately 50 mm or less for the terminal embedded in the narrow sides 3*b*. In the well known, width-variable mold provided with displaceable narrow sides for changing the casting width, the temperature detecting terminals are preferably embedded in the narrow sides. It is also possible in the width-variable mold to embed a plurality of temperature-detecting terminals along the wide sides and to select an appropriate temperature-detecting terminal depending upon the variations in the mold width. The temperature-detecting terminals are preferably embedded at least 100 mm beneath the level of melt within a mold in the casting direction. One temperature-detecting terminal or a plurality of temperature-detecting terminals at an appropriate vertical distance therebetween may be disposed provided that the most upstream temperature-detecting terminal is embedded 100 mm beneath the level of melt. The determining of a BO generation can be then carried out in several stages where the temperature-detecting terminals are disposed.

Table 1 below illustrates several possible combinations of the positions where $\Delta T_1$ and $\Delta T_2$ are obtained.

TABLE 1

| Patterns | 700a | 700b | 700c | 700d | 701a | 701b | 701c | 701d |
|---|---|---|---|---|---|---|---|---|
| 1 | o | o | x | x | | | | |
| 2 | | | | | o | o | x | x |
| 3 | o | x | o | x | | | | |
| 4 | | | | | o | x | o | x |
| 5 | o | x | x | o | | | | |
| 6 | | | | | o | x | x | o |

In the above table, symbols o and x indicate the pair for calculating the temperature difference $\Delta T_1$ or $\Delta T_2$. As given in the table above, the inter-corner temperature for calculating $\Delta T_1$ and $\Delta T_2$ can be any one using, as the standard for determining the pair of detecting positions, the axis X along the narrow sides, the axis Y along the wide sides, and the center Z of the mold cross section.

[Second Example]

Figure 21:
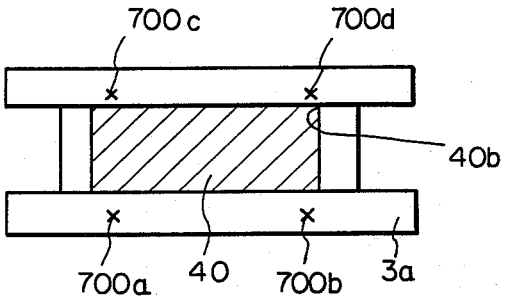
Figure 22:
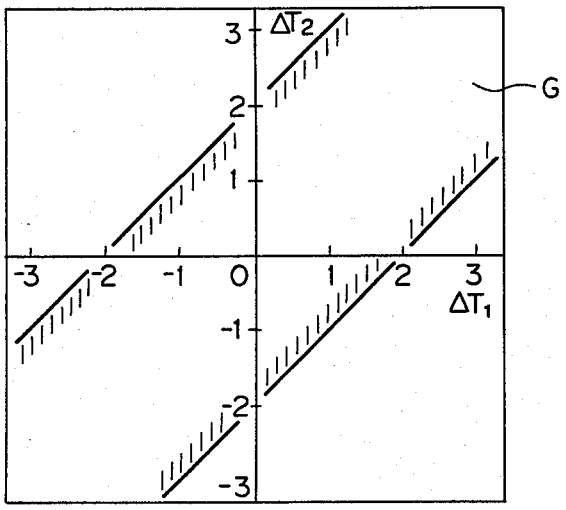

The present invention was implemented in a continuous casting plant for producing a casting 1000 mm in width and 250 mm in thickness. As shown in FIG. 21, the thermocouples 700*a*–700*d* were embedded in the wide sides 3*a*. The distance of the thermocouples 700*a*–700*d* from the corners 40*b* of the casting 40 was approximately 50 mm and their vertical distance was 200 mm from the level of the melt. Only one thermocouple was disposed in the casting direction. By using the mold described above, the ordinary continuous casting operation was carried out at a casting speed of 1.6 m/min. The inter-corner temperatures $\Delta T_1$ (700*a*–700*b*) and $\Delta T_2$ (700*c*–700*d*) were calculated at the time the surface cracks were actually generated. The defect generating-power coefficients were investigated using the difference $\delta = \Delta T_1 - \Delta T_2$. The defect generating-power coefficients investigated are outside the region G shown in FIG. 22.

Figure 23:
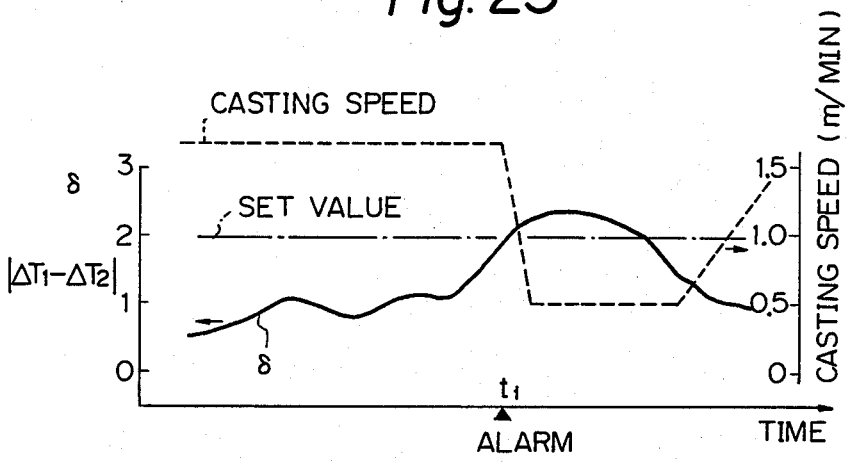

Subsequently, the inter-corner temperatures $\Delta T_1$, $\Delta T_2$ and the defect generating-power coefficients were successively calculated, during the continuous casting operation, using the thermocouples. FIG. 23 illustrates the variations in the difference δ. The difference δ entered at time $t_1$ the preliminarily obtained range of power coefficients. It was therefore determined that a surface defect would generate on the casting 40. Immediately, the alarm was generated and the casting speed was lowered to 0.5 m/min, and the BO was prevented.

A method for predicting the engulfing BO is described.

Figure 24:
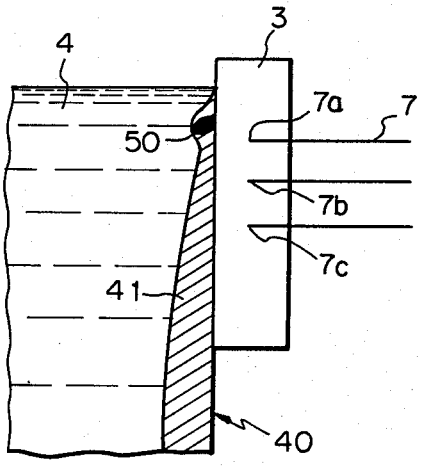
FIG. 24 is a partial cross sectional view of a mold in which the temperature-detecting terminals are embedded in accordance with the present invention.
Figure 25A:
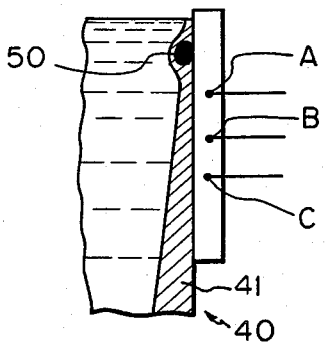
FIGS. 25(A), (B), and (C) illustrate the BO occurring during the movement of a casting.
Figure 25B:
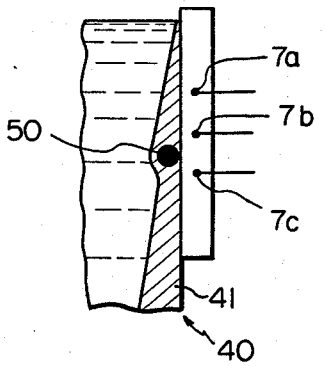
Figure 25C:
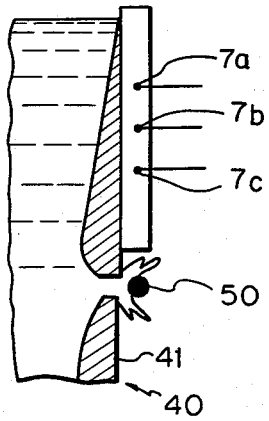
Figure 26:
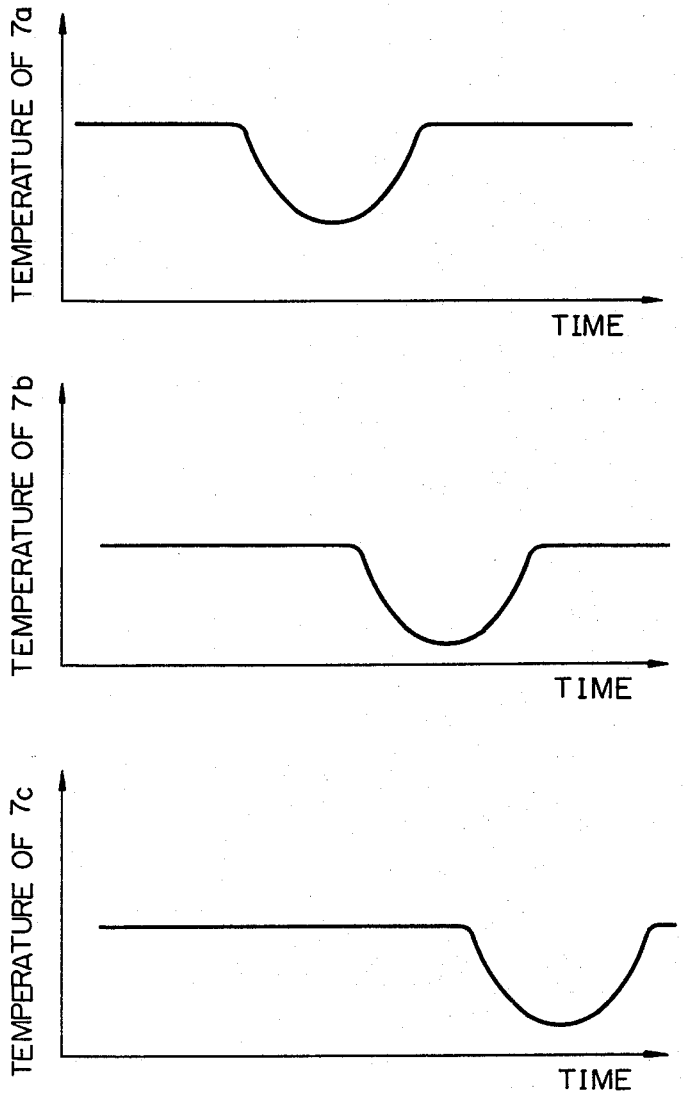
FIG. 26 illustrates an example of the sequential change of temperature detected by the temperature-detecting terminals embedded in the mold.

Referring to a partial cross sectional drawing of the mold shown in FIG. 24, which corresponds to FIG. 4 for the case of a constraint BO, the temperature-detecting terminals 7*a*, 7*b*, and 7*c* are embedded in the mold, along a moving direction of the casting at an appropriate distance. The molten steel is denoted by 4, the casting is denoted by 40, the solidifying shell grown on the surface layer of the casting 40 is denoted by 41, and the large sized inclusion engulfed between the mold 3 and the solidifying shell 40 is denoted by 50. It is known that the large sized inclusion 50 engulfed as mentioned above gradually moves downward, during the progress of casting, at a speed which is in agreement with the casting speed. FIGS. 25(A), (B), and (C) illustrate the movement of the large sized inclusion 50. In FIG. 25(A), the large sized inclusion 50 is engulfed between the mold 3 and the solidifying shell 41. In FIG. 25(B), the large sized inclusion 50 sinks lower as compared with the engulfed position, as the continuous casting proceeds. Regarding the case of a constraint BO, in which the solidifying shell 4 ruptures at a position directly beneath the point at which it sticks to the mold, as described above, it was discovered by an experiment of the present inventors that the rupturing part moves within a mold at a speed 0.6–0.9 times that of the casting speed, that is, at a speed slower than the casting speed. Contrary to this, the moving speed of the large sized inclusion 50 is virtually the same as the casting speed. In addition, the constraint BO propagates along the width of a casting 40, but the BO caused by engulfing of the large sized inclusion 50 does not propagate along the width of a casting 40. This is an outstanding feature of the BO caused by engulfing of the large sized inclusion 50. When the large-sized inclusion 50 descends further, as shown in FIG. 25(C) and finally arrives at the lower end of the mold, the part of the solidifying shell, in which the large sized inclusion 50 is engulfed ruptures, and a BO is generated. The temperature values detected by the temperature-detecting terminals *7a–7c* change as shown in FIG. 26 in accordance with the movement of the large sized inclusion 50 illustrated in FIGS. 25(A) through (C). As is apparent from FIG. 26, the temperature values detected fall less than an average temperature when the large sized inclusion 50 passes the embedding position of the temperature-detecting terminals 7. That is, a deviation of temperature from a steady level down to a low temperature occurs. This deviation first occurs at the temperature-detecting terminal *7a*, then at the temperature-detecting terminal *7b* after a crtain lapse of time, and at the temperature-detecting terminal *7c* after a further lapse of time.

A BO-prediction in accordance with the present invention is carried out by detecting the deviation wherein the temperature values detected by at least two temperature-detecting terminals arranged in the casting direction successively shift to a low temperature-side. The BO-prediction by the successive shift means, i.e., simultaneous shifts of the temperature values, which are detected by the temperature-detecting terminals arranged in the casting direction, are not an indication of a BO. Empirically, the simultaneous shifts are caused generally by a change in the casting operation, such as a change in the casting speed.

A specific method for detecting successive shifts of the at least two temperature-detecting terminals is described with reference to the block diagram shown in FIG. 27.

An average value is obtained from the temperature values detected at a plurality of the temperature-detecting terminals at a time before the present time. This average value is used as the steady level and is subtracted from the temperature value detected at the present time $X_1$ to obtain the difference D. This substraction is carried out by an arithmetic logic unit 21. The difference D is compared with a predetermined set quantity of temperature variance $K_{c1}$ in the comparator 22. Upon detection by the comparator 22, that the $K_{c1}$ exceeds the difference D the changing quantity of temperature per unit time $X_2$ is calculated and is compared with a predetermined set value $K_{c2}$ for the temperature-changing rate in the changing-rate unit 23. A decision is made to the effect that a deviation exceeding the steady level has occurred when the difference D exceeds $K_{c1}$ and $X_2$ exceeds $K_{c2}$. This decision is first made when the deviation mentioned above occurs with regard to the temperature which is detected at the temperature-detecting terminal embedded in the most upstream position of the mold. After the first decision mentioned above, the next decision is made in the unit that a deviation exceeding the steady level occurs with regard to the temperature which is detected by a next temperature-detecting terminal embedded downstream of the most upstream terminal. The time $X_1$ from the first and next decisions is calculated in the time-series unit 24 and is then compared with a range of time ($t_8$–$t_9$) which is predetermined by the casting speed and distance between the upper and lower temperature-detecting terminals.

According to the above procedure, the temperature is detected by separate terminals, the so-detected temperature values are calculated to obtain the average value M and the values $X_1$ at the present casting, $D=X_1-M$ is calculated, the difference D is compared with the set value for the temperature-changing rate $K_{c1}$, and the measured temperature-changing rate $X_2$ is compared with the set value $K_{c2}$. An accurate detection of the deviation from a steady level can be made by the comparisons of the set values $K_{c1}$ and $K_{c2}$ mentioned above. An accurate BO-prediction can be made by detecting that the above mentioned deviation occurs, with a time delay of a predetermined interval at at least two temperature-detecting terminals which are arranged successively in the casting direction.

Figure 27:
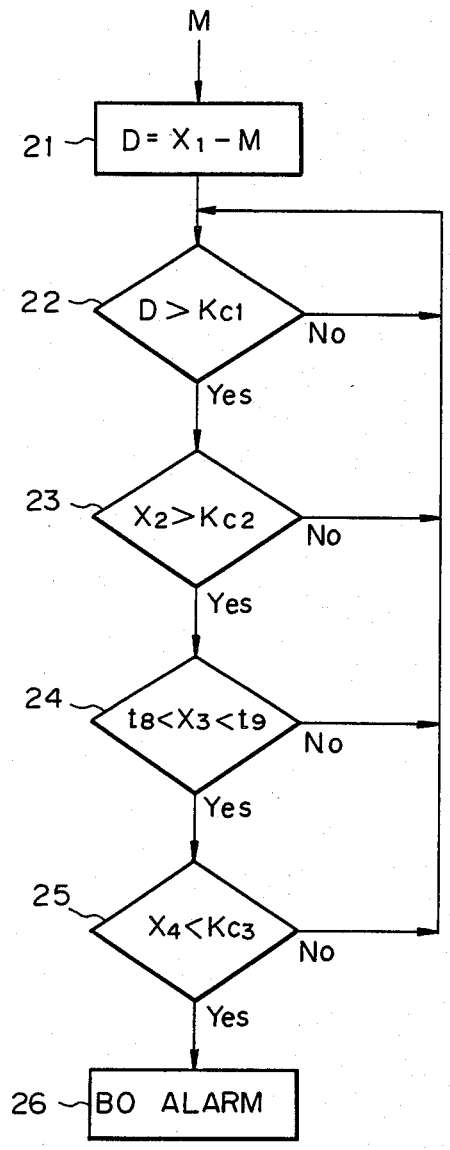
FIG. 27 is a block diagram illustrating a specific means for judging anomalies in accordance with the present invention.

In the block diagram shown in FIG. 27, in addition to the detemmining procedure as described above, the difference $X_4$ between the temperature values detected by the upstream and downstream terminals, respectively, is calculated and then compared with the set value $K_{c3}$ which has been set, based on the BO occurrences in the past, to indicate the temperature proximity at such terminals. The comparison mentioned above therefore results in a decision of whether or not the temperature values are so close to one another as to cause BO. When $X_4<K_{c3}$, the alarm is generated to warn of a BO. The temperature-proximity decision unit is denoted by 25 and the alarm unit is denoted by 26 in FIG. 27.

According to the experiments by the present inventors, the position of the temperature-detecting intervals 7 is preferably at least 100 mm beneath the level of the melt in a mold, since the detected values do not vary depending upon the variance in the level of the molten steel melt. In addition, at least two temperature-detecting terminals are preferably located in the casting direction, with a distance of 50 mm or more therebetween, since this enables the movement of a ruptured part of solidifying shell therebetween to be accurately detected.

[Third Example]

Figure 28A:
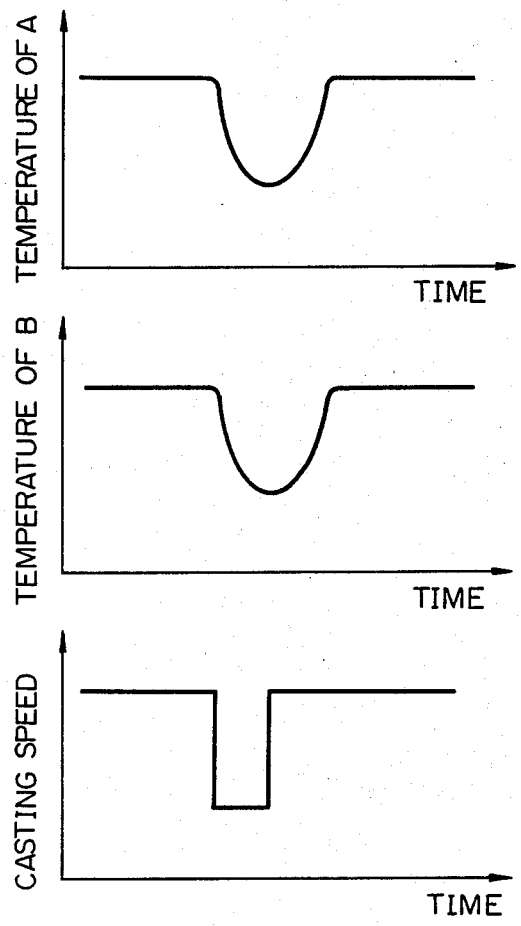
FIGS. 28(A), (B), and (C) are charts showing the temperature detected in accordance with an example of the present invention.
Figure 28B:
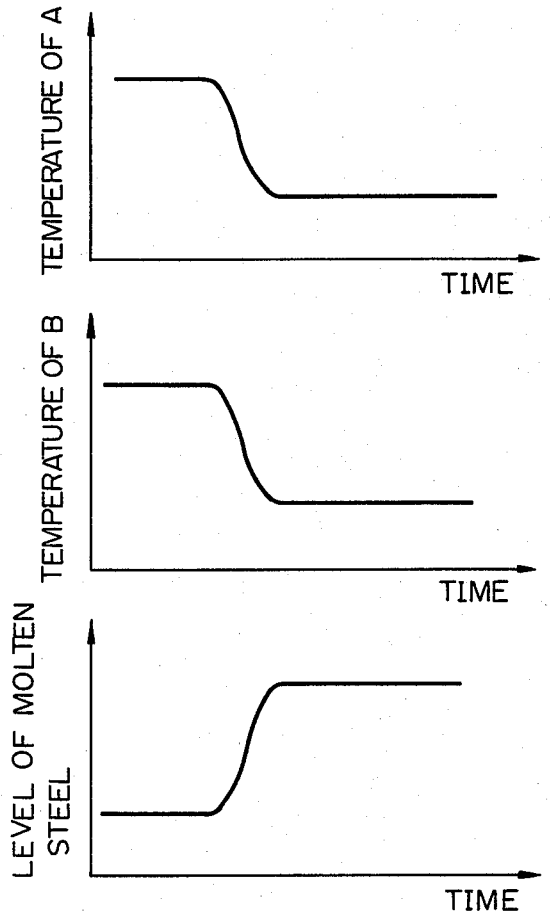
Figure 28C:
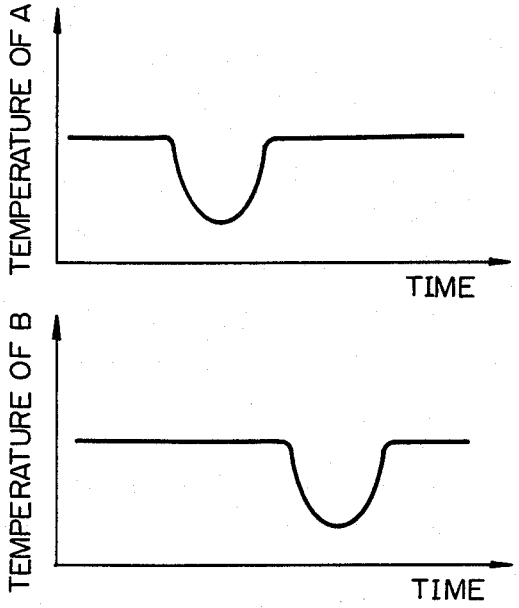

The present invention was implemented in the continuous casting mold for producing a casting 1000 mm in width and 250 mm in thickness by using the mold as shown in FIG. 15. Referring to FIGS. 28(A), (B), and (C), a sequential temperature change detected by the thermocouples in "A" row is illustrated for the casting at a speed of 1.6 m/min. The temperature values detected by the thermocouples *7a*, *7b* varied as shown in FIG. 28(A) when the casting speed varied. The temperature values detected by the thermocouples *7a*, *7b* varied as shown in FIG. 28(B) when the level of molten steel varied in the mold. Since the temperature values detected by the thermocouples *7a*, *7b* shifted virtually simultaneously to a low-temperature side, the determination that a BO was not generated was made, and the continuous casting was continued further without the occurrence of a BO. The temperature values detected by the two thermocouples *7a*, *7b* varied, in the case of engulfing a large-sized inclusion, as shown in FIGS. 28(C), such that they consecutively shifted from a steady level to a low-temperature side. A BO was predicted based on detection of the consecutive shift, an alarm was generated, and the casting speed was lowered.

Figure 29:
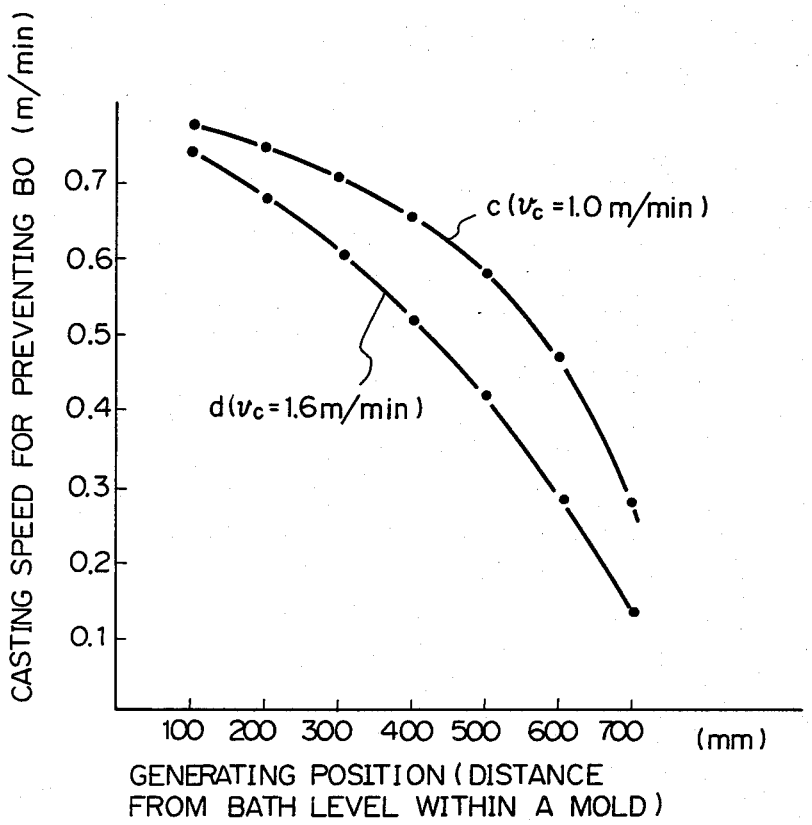
FIG. 29 is a graph showing an example of a speed-reduction pattern which allows the avoidance of an engulfing BO.

As described hereinabove, when the cast defects are predicted by a predictor 11, the signals indicating the kind and position of cast defect are input to the unit setting the casting speed. Also input to the unit for the setting casting speed 12, are such operating conditions as the steel grade and size of a casting, casting speed, oscillation frequency, amplitude, and oscillation waveform of a mold. The unit for setting the casting speed 12 sets a pattern of casting speed-change which allows the cast defect to be avoided, using the position and kind of cast defect signals and the operating conditions. The pattern of a casting speed-change is selected from the speed-increase or reduction patterns which have been preliminarily determined based on past experience, and in accordance with the various operating conditions. The speed-increases and reductions are collectively referred to as the change of casting speed. In example of a pattern of casting speed-reductions for avoiding the engulfing BO is illustrated in FIG. 29. The abscissa and ordinate of FIG. 29 indicate the position of generation of a cast defect and the casting speed which allows the cast defect to be avoided. The solid lines "c" and "d" correspond to the casting speeds of 1 m/min and 1.6 m/min, respectively. FIG. 29 teaches, for example, the following. That is, when, during the operation at a casting speed of 1.6 m/min, a prediction is made that a large sized inclusion is engulfed in a solidifying shell 200 mm beneath the level of melt, the casting speed should be lowered to 0.68 m/min. When the casting speed of 0.68 m/min is maintained until the engulfed inclusion cast defect passes the bottom end of a mold, insufficient heat withdrawal from the molten steel, which would occur at the ordinary casting speed (1.6 m/min), is prevented, so that delay in the growth of the solidifying shell is also prevented, thereby ensuring a thicker solidifying shell than normal and preventing the engulfing BO not withstanding the engulfing of an inclusion. The values shown in FIG. 29 were obtained with a 872 mm-long mold, the level of melt being 100 mm beneath the top end of a mold.

Similar to the speed-reduction pattern shown in FIG. 29, for avoiding the engulfing BO, the speedreduction pattern for avoiding the crack-type BO can be obtained using the BO avoidance-cases in the past.

According to the experience of the present inventors, the casting speed-reduction necessary for avoiding the crack-type BO was slight as compared with that for avoiding the engulfing BO. Accordingly, the patterns of casting speed-reduction for avoiding the engulfing BO could be also used for avoiding the crack-type BO, practically speaking. Evidently, the reduction in casting speed can be kept to a minimum level, when an accurate pattern of speed reduction is determined for avoiding the crack-type BO and the casting speed is lowered in accordance with such a pattern.

Figure 30:
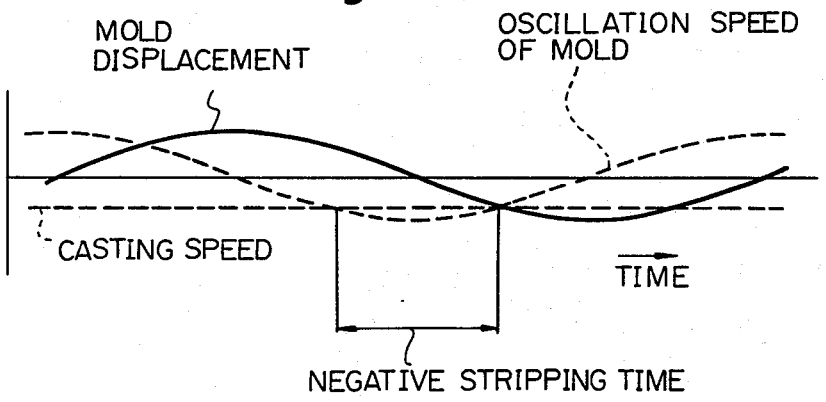
FIG. 30 is a chart showing a relationship between the oscillation speed of the mold and the casting speed where a sine wave is used for imparting oscillation to a mold.
Figure 31:
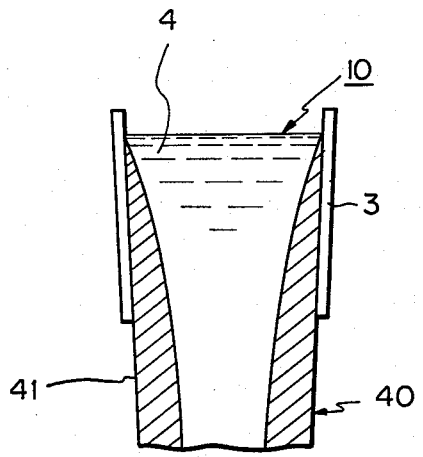
FIG. 31 is a cross sectional view of a mold, for illustrating a normal casting state in the mold.
Figure 32:
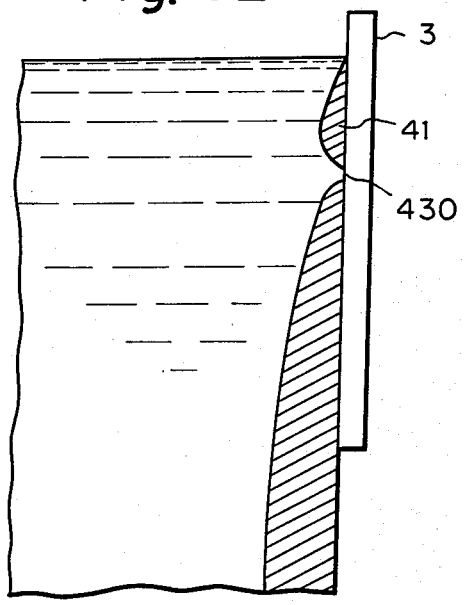
FIG. 32 is a cross sectional view of a mold, for illustrating a casting state in which a constraint BO is generated.
Figure 33:
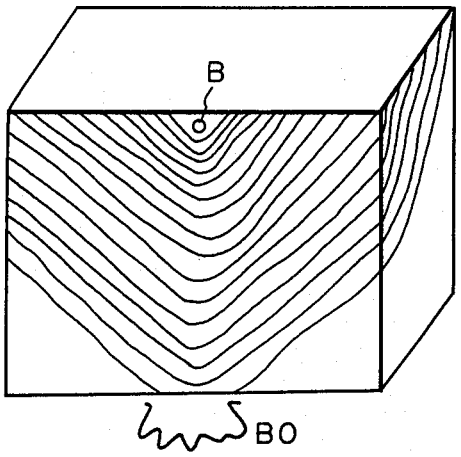
FIG. 33 schematically shows a surface shape of a casting actually exhibiting a BO.

Regarding the constraint BO, since the rupture of a solidifying shell occurs within a mold as described hereinabove, the ruptured solidifying shell must be repaired within a mold. In order to repair the ruptured solidifying shell, it is desirable to ensure a negative stripping time, i.e., a time period in one oscillation cycle, in which a movement speed of a mold in the casting direction is greater than the casting speed, which is longer than a certain value, as described hereunder. As is well known, an oscillation movement in the casting direction is imparted to a mold so as to cause the lubricant, such as powder, to flow effectively in between the inner surface of the mold and the solidifying shell and to prevent sticking between a casting and the mold. Referring to FIG. 30, the relationship between the casting speed and the displacement speed of a mold is illustrated for the case where the oscillation movement is imparted to the mold utilizing a sine wave. The negative stripping time (hereinafter referred to as "$T_N$ time") is the time period in which the mold descends at a higher speed than the casting speed within the time period of one cycle. The other time period is the positive strip time (hereinafter referred to as the "$T_p$ time"). In the $T_N$ time, the solidifying shell is subjected to a compression force, while in the $T_p$ time the solidifying shell is subjected to a tensional force. Generally speaking, the molten steel poured into a mold 3 (FIG. 31) starts to solidify at the part in contact with the mold 3, due to heat withdrawal through the conacting part. The solidifying shell 41 gradually thickens as it is displaced lower. The cooling condition of a mold 3 and the other casting conditions are set to provide a predetermined thickness of the solidifying shell 41 at the bottom end of the mold 1. In FIG. 31, the molten steel is denoted by 4, the casting is denoted by 40, and the surface level of molten steel 4 is denoted by 10. When the solidifying shell 41 sticks to the mold 3, a constrained state of the solidifying shell 41 is generated, and a rupture of solidifying shell 41 occurs, as shown in FIG. 32, at 430. The rupture of the solidifying shell 41 caused within a mold 3 due to constraining by the mold is herein referred to as the constraint rupture. The constraint rupture causes a constraint BO when the ruptured part is not repaired within a mold. Studies of the constraint rupture have been made by observing the surface shape of castings which actually exhibited a constraint. As a result of the studies, it has been confirmed that, as a schematically shown in FIG. 33, the constraint beginning-part of a solidifying shell behaves as a starting point "B", from which the rupture propagates in the casting direction and along the width of a casting, and further, the ruptured part 430 causes the BO when such part 430 leaves the mold 3.

Figure 34:
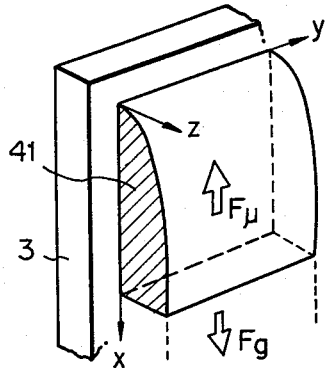
FIG. 34 schematically shows a growth of the solidifying shell 41 within a mold during a steady state.

The present inventors performed further researches and studies for the formation circumstances of the solidifying shell and the mechanism of a rupture of the solidifying shell. When the solidifying shell 41 grows under an ordinary condition, the growing circumstance thereof is as schematically shown in FIG. 34. The solidifying shell 41 is subjected to a frictional force $F\mu$ due to the friction between the solidifying shell 41 and the mold 3 as well as the gravity Fg. The frictional force $F\mu$ and the gravity Fg are expressed by the formulas (4) and (5), where the casting direction, the direction along the width of a casting, and the direction along a thickness of a casting are taken as the x, y, and z axes, respectively.

$$F\mu = \int_0^{Vc\cdot t}\int_0^{B} \mu\cdot\rho_l\cdot x\cdot dy\cdot dz = \frac{1}{2}\cdot\mu\cdot\rho_l\cdot B\cdot V_c^2\cdot t^2 \quad (4)$$

$$Fg = \int_0^{Vc\cdot t}\int_0^{B}\int_0^{m\left(\frac{X}{Vc}\right)^n} \rho s\cdot dz\cdot dy\cdot dx = \left(\frac{m}{n}+1\right)\cdot\rho s\cdot B\cdot Vc\cdot t^{n+1} \quad (5)$$

$\mu$: coefficient of friction between the solidifying shell and the mold $\rho_l$: specific gravity of molten steel (kg/mm$^3$)

$\rho s$: specific gravity of solidifying shell (kg/mm$^3$)

Vc: casting speed (mm/sec)

B: width of a slab (mm)

t: time lapse from the surface level of molten steel in a mold (sec)

m, n=solidification coefficients (generally m=1.475, n=0.66) (solidification thickness=$m^{tn}$ The proof strength $F\sigma$ of the solidifying shell 41 is expressed by the formula (6).

$$F\sigma = \int_0^B \int_0^{m\left(\frac{x}{Vc}\right)^n} \sigma \cdot dz \cdot dy = B \cdot m \cdot \tau^{tn \cdot \sigma} \quad (6)$$

$\sigma$: yield stress of the solidifying shell (kg/mm²)

$\sigma$: average yield stress of solidifying shell along the width (kg/mm²)

$$\left( \sigma = \frac{\int_0^{m \cdot t^n} \sigma \cdot dz}{\int_0^{m \cdot t^n} dz} \right)$$

Figure 35:
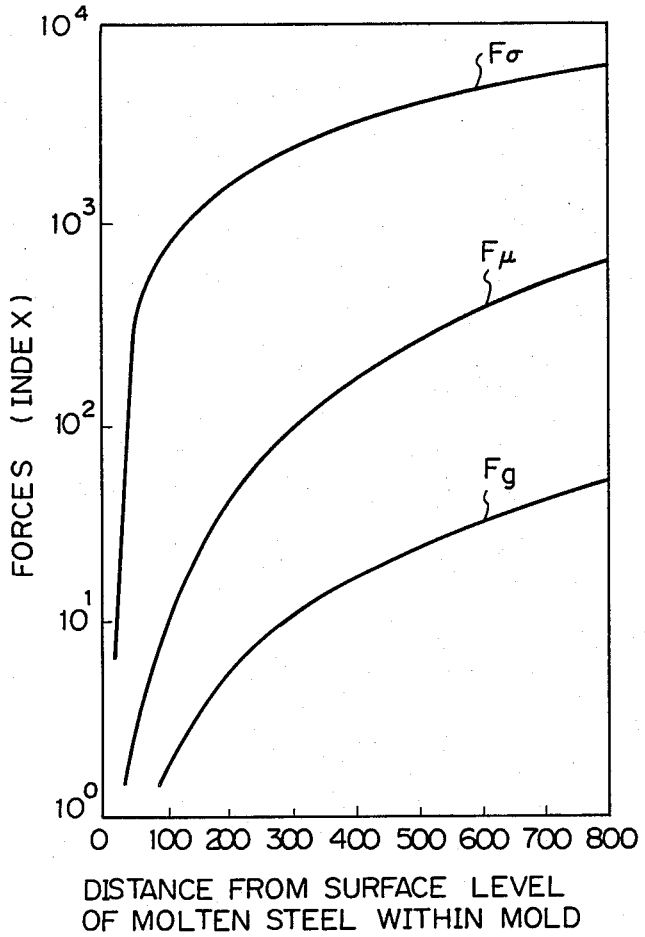
FIG. 35 is a graph showing the result of calculating the forces Fa, Fb, and Fc under a steady state.

$F\mu$, Fg, and $F\sigma$ obtained by the formulas (4), (5), and (6), respectively, are as shown in FIG. 35. $F\sigma > F\mu - Fg$ is always satisfied under an ordinary condition, and hence the solidifying shell 41 does not break within the mold 3.

Figure 36:
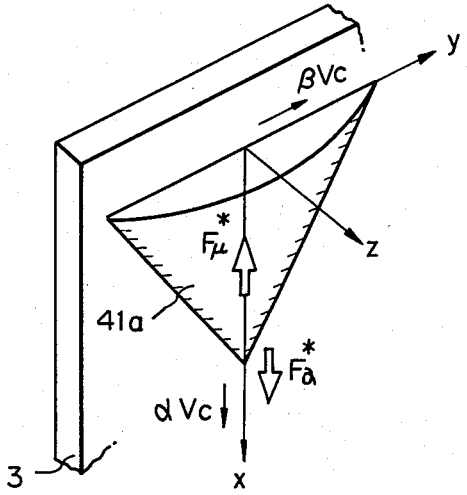
FIG. 36 schematically illustrates how the solidifying shell grows within a mold when a rupture of the solidifying shell occurs.

However, when the rupture mentioned above occurs, the forces acting in the solidifying shell 41*a* balance as described in the following with reference to FIG. 36. In FIG. 36 the solidifying shell 41*a* is schematically shown. The frictional force $F^*\mu$ is expressed by the formula (7), where $\alpha$ and $\beta$ are the propagation ratios to the casting direction and the direction along the width of a casting.

$$F^*\mu = 2 \int_0^{\alpha \cdot Vc \cdot \tau^t} \int_0^{\frac{\beta}{\alpha} x + \beta \cdot Vc \cdot t} \mu \cdot \rho_l \cdot x \cdot dy \cdot dz = \frac{\mu}{3} \cdot \rho_l \cdot \alpha^2 \cdot \beta \cdot Vc^2 \cdot t^3 \quad (7)$$

Since the molten steel fi[illegible] ruptured part 430 and hence the F*g (gravity force of t[illegible] olidifying shell 41*a*) is compensated by the [illegible]ancy, the F*g is very small and is negligible.

The solidifying [illegible] above the ruptured part 430 and sticking to the [illegible]old 3, is subjected to the inertia force F*α [illegible] rom the mold oscillation, since the [illegible] occurs and causes the rupture.

$$[illegible] (2\pi f)^2 \cdot F^*g \cdot S/2g \quad (8)$$

$$F^*g = 2 \cdot \int_{\beta \cdot Vc \cdot t \frac{\beta}{\alpha} x}^{0} \int_{m\left(\frac{x}{\alpha \cdot Vc}\right)^n}^{0} \rho s \cdot dz \cdot dy \cdot dx \quad (8')$$

g: gravitational acceleration f: number of os[illegible]lations of a mold ($sec^{-1}$)

s: oscill[illegible]on stroke of a mold (mm)

The proof stress F*o of the solidifying shell 41 is expressed by the formulas (9)–(12), when a premise is given that the F*α is determined by the solidifying shell formed during the time $T_N$, in which the solidifying shell is subjected to compression, and $F^*\sigma$ exhibits the maximum value at the end of the $T_N$ time.

$$F^*\sigma = 2 \cdot \int_0^{(\alpha^2 + \beta^2)^{\frac{1}{2}} \cdot Vc \cdot T_N} \int_0^{m \cdot T_n^n} \tau \cdot dz \cdot dl = 2 \cdot l \cdot m \cdot T_N^n \cdot \tau \quad (9)$$

$$l = (\alpha^2 + \beta^2)^{\frac{1}{2}} Vc \cdot t \quad (10)$$

$$T_N = (1/\pi f) \cdot \{(\pi/2) - \sin^{-1}(Vc/\pi/f/S)\} \quad (11)$$

$$\tau = \sigma/3^{\frac{1}{2}} \quad (12)$$

$\tau$: average shear stress of solidifying shell (kg/mm²)

$T_N$: negative stripping time (sec)

Figure 37:
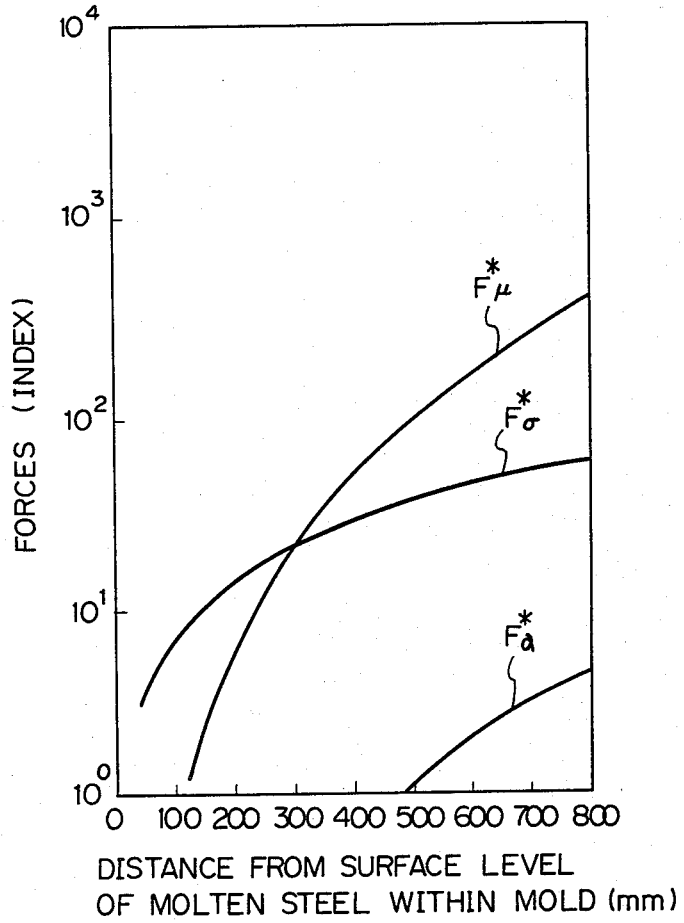
FIG. 37 is a graph showing the result of a example of the calculations for the forces F*a, F*b, and F*c when the solidifying shell is ruptured.

The above formulas were used to obtain $F^*\mu$, F*a, and $F^*\sigma$ at the time of a generation of a rupture of the solidifying shell. The results are given in FIG. 37. As is apparent from FIG. 37, $F^*\sigma < F^*\mu - F^*a$ is satisfied when the rupture is generated 300 mm beneath the level of the molten steel. At the position of a solidifying shell, where the relationship $F^*\sigma < F^*\mu - F^*a$ is satisfied, the rupture propagates only due to the frictional force by ferrostatic pressure even when the constraining force is relieved due to, for example, shrinkage of a solidifying shell. It is understood from the above considerations that, in order to prevent progress of the rupture and to repair the rupture, endeavours should be made to attain $F^*\sigma > F^*\mu - F^*a$, i.e., the solidifying shell should be grown in the $T_N$ time to attain $F^*\sigma > F^*\mu - F^*a$. Since the longer the $T_N$ time, the greater the growth of the solidifying shell as described above, $F^*\sigma > F^*\mu - F^*a$ can be attained by increasing the $T_N$ time. That is, a satisfactorily long $T_N$ time is selected depending upon the casting speed and a time lapse from the level of the melt within a mold.

Next, the requisite thickness of a solidifying shell is described.

Figure 38:
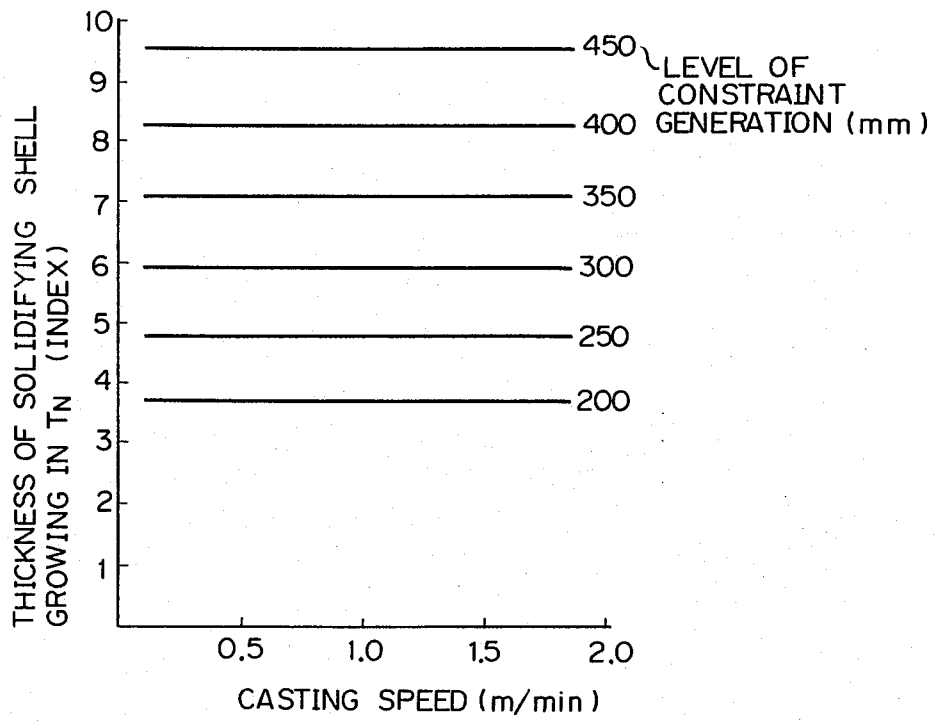
FIG. 38 is a graph showing the result of an example of the calculations for the correlationship between the thickness of a solidifying shell growing during a negative stripping time $T_N$ and the casting speed, with parameters of the respective levels of constraint generation.

The present inventors investigated the rupture circumstances of the solidifying shell in the cases of a BO occurring in the past and found that the propagation ratios $\alpha$ and $\beta$ in the casting direction and along the width of a casting are each 0.75 ($\alpha = \beta = 0.75$). Based on this finding, the present inventors obtained the repairing or restoring condition of a solidifying shell, i.e., a condition under which, when the ruptured part 430 arrives 200–450 mm beneath the level of the melt, the ruptured part 430 is repaired or restored under the relationship $F^*\sigma = F^*\mu - F^*a$. An example of these results is given in FIG. 38, in which the abscissa indicates the casting speed and the ordinate indicates the thickness (expressed by index) of a solidifying shell grown within the $T_N$ time. In FIG. 38, the levels of constraint generation, i.e., the distances of a ruptured position from the level of a melt, are shown as parameters.

Figure 39:
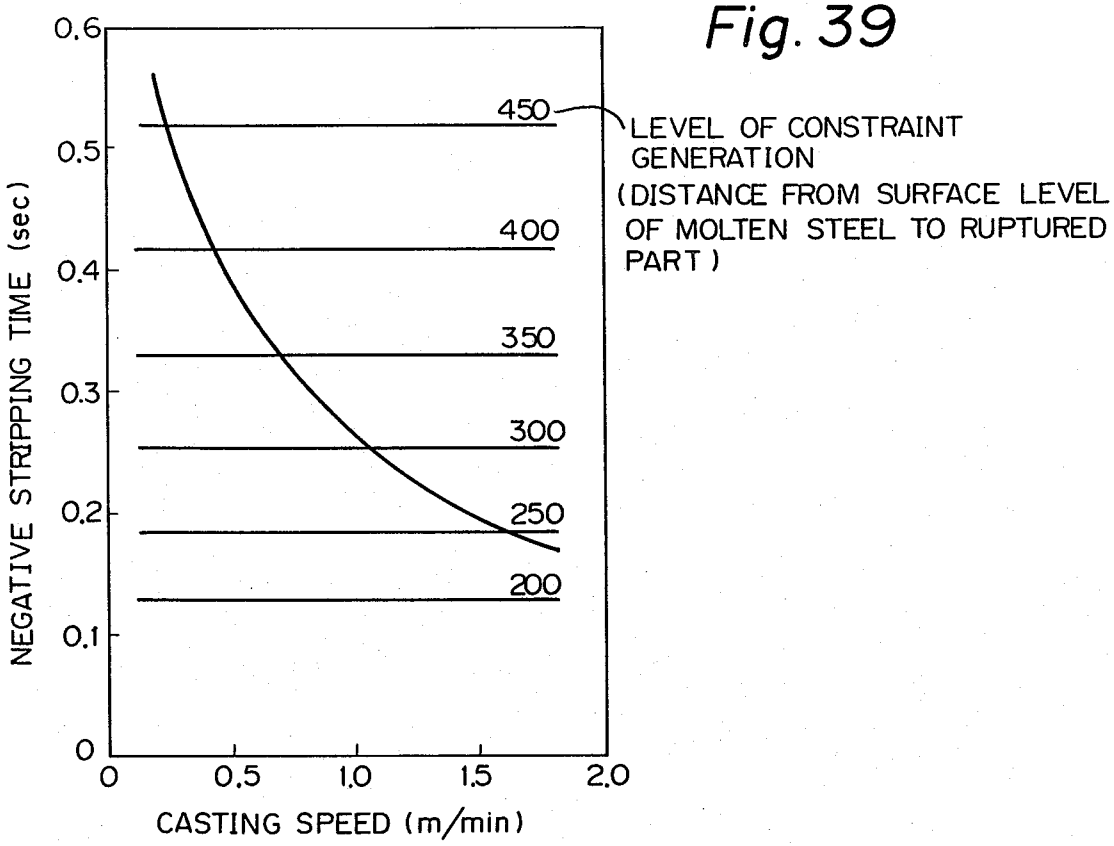
FIG. 39 is a graph showing an example of the results of calculation for the negative stripping time $T_N$ which is necessary for obtaining the requisite thickness of a solidifying shell required for avoiding a BO.

As is illustrated in FIG. 23, the further the rupture propagates, the greater the increase of the area of the rupture in the solidifying shell. Since the more the rupture propagates downwards the greater becomes the ferrostatic pressure, the frictional force $F^*\mu$ also becomes greater, as expressed in the formula (7). Accordingly, the requisite thickness of a solidifying shell becomes greater, and the rupture occurs at a deeper position from the level of the melt. FIG. 39 shows an example of the results for calculating the growth time, i.e. the $T_N$ time, of a solidifying shell having the requisite thickness. The curve shown in FIG. 39 indicates a condition for the mold-oscillation, in which f (number of oscillations of mold)=0.054 Vc (mm/sec)+0.667 (cps) and S=12 mm. The mold is oscillated in a sine-wave. In the continuous casting using such a mold, the lowering of the casting speed and hence the increase in the $T_N$ time can be such that for the level of constraint-generation of 300 mm the Vc is 1.0 m/min or less (Vc<1.0 m/min), and for the level of constraint-generation of 400 mm, the Vc is 0.4 m/min or less (Vc<0.4 m/min). Note that here Vc<1.0 or 0.4 m/min.

Figure 40:
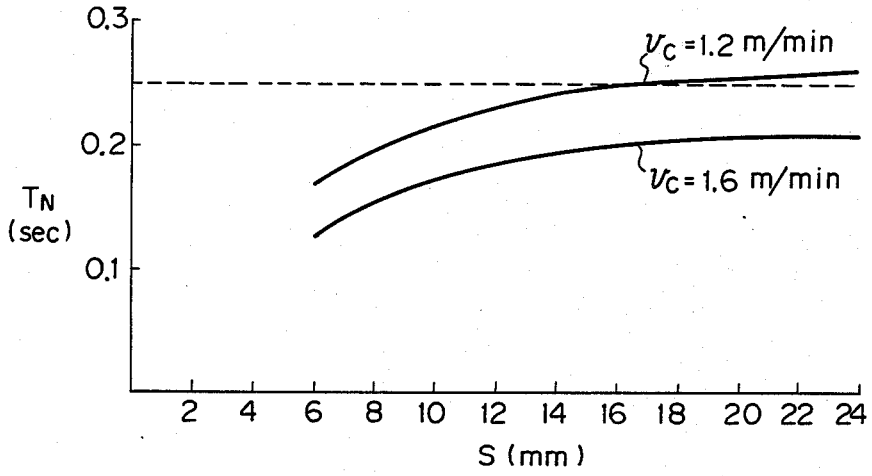
FIG. 40 is a graph showing the relationship between the mold amplitude S and the negative stripping time $T_N$.
Figure 41:
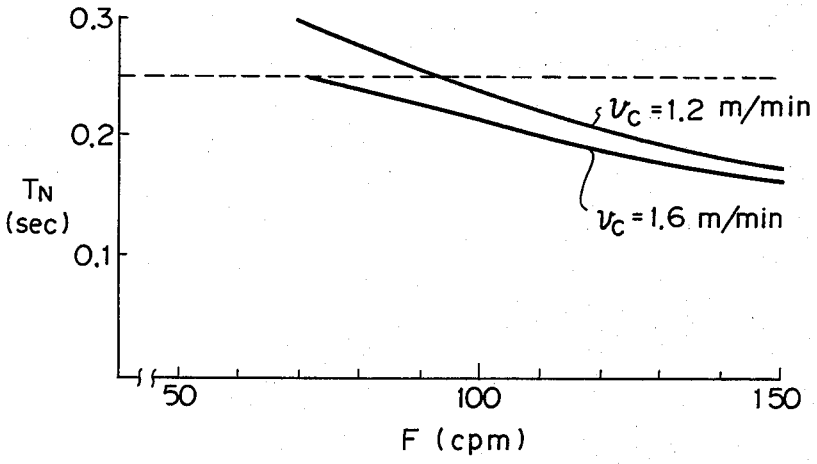
FIG. 41 is a graph showing the relationship between the mold frequency F and the negative stripping time $T_N$.
Figure 42:
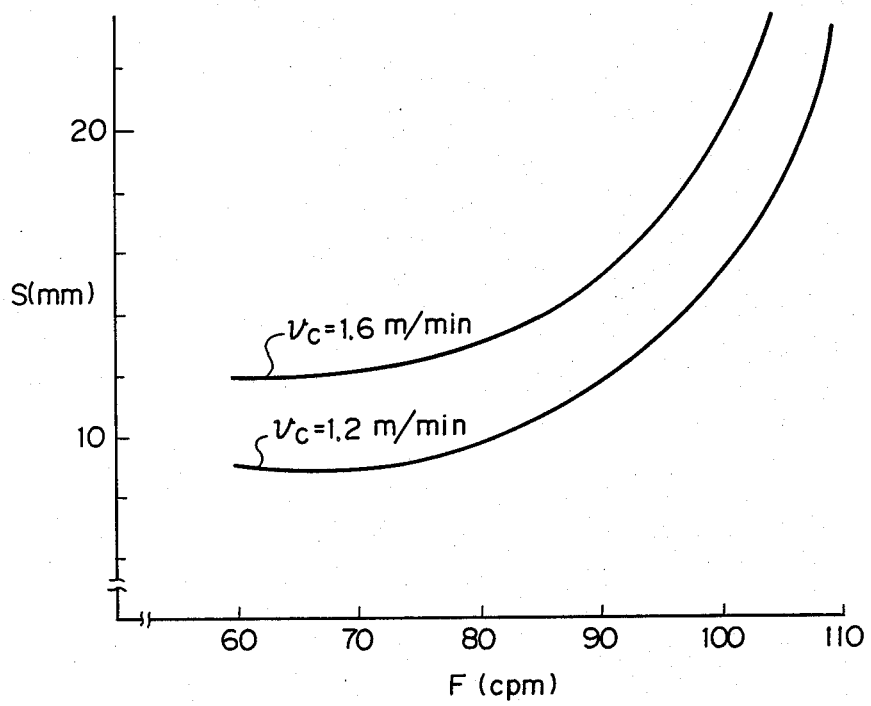
FIG. 42 is a graph showing the relationship between the mold amplitude S and the frequency F, under which S and F a time $T_N$ of 0.25 second or more is ensured.

Referring to FIG. 40, relationships between the amplitude of the mold oscillation S and the $T_N$ time, are shown. Provided that the $T_N$ time can be increased only by increasing the amplitude of the mold oscillation S, at the casting speed (Vc) of 1.2 m/min, the amplitude (S) should be greater than 20 mm (S>20 mm). Referring to 41, relationships between the frequency of the mold (F in cycles per minute) and for the $T_N$ time are shown. The $T_N$ time can be increased only by lessening the frequency of the mold (F). When the casting speed (Vc) is 1.2 m/min, the frequency of the mold (F) is less than approximately 90 cpm (F<90 (cpm)). Referring to FIG. 42, relationships between the S and F, for obtaining $T_N \geqq 0.25$ sec are shown. $T_N > 0.25$ sec is obtained above the solid lines and, therefore, $T_N > 0.25$ second can be ensured by adjusting the S and F values above the solid line shown in FIG. 42, so that a solidifying shell can have a thickness greater than that required for repairing the ruptured part. The $T_N$ time can be increased by changing the S and F values while maintaining the shape of the oscillation wave. Alternatively, the oscillation can be changed from a sine wave to a rectangular wave. As described above, a rupturing position of the solidifying shell, i.e., the constraint-generation level, is detected in terms of a time lapse from the level of the molten steel, and the oscillation parameters are changed, as shown in FIG. 39, depending upon the constraint-generation level and the casting speed, so as to obtain a $T_N$ time which is required for repairing or restoring the ruptured solidifying shell. Thus a BO can be prevented. Once generated, the rupture tends to enlarge within a mold. However, when the $T_N$ time is 0.25 second or longer, the solidifying shell appears to grow more rapidly than the enlarging of the ruptured part.

The ruptured solidifying part can therefore be restored, in the $T_N$ time of 0.25 second or longer, and a shell thickness obtained that is free of ruptures.

Figure 43:
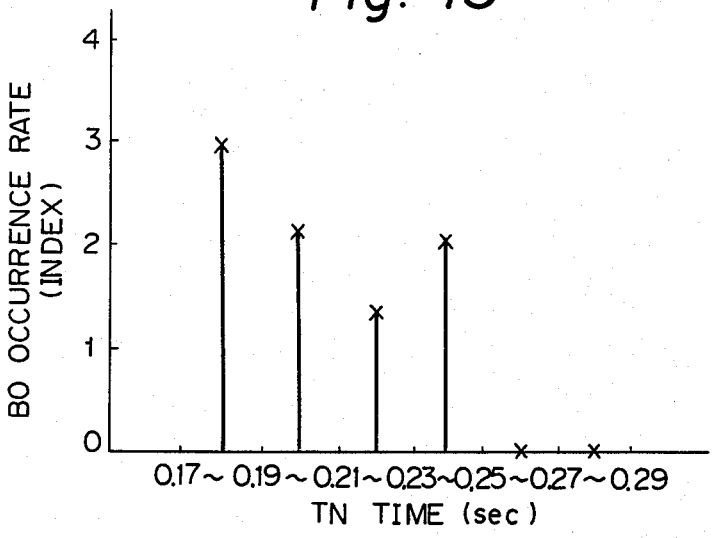
FIG. 43 is a graph showing an example of the results obtained for determining the relationship between the negative stripping time $T_N$ and the BO occurrence rate.
Figure 44:
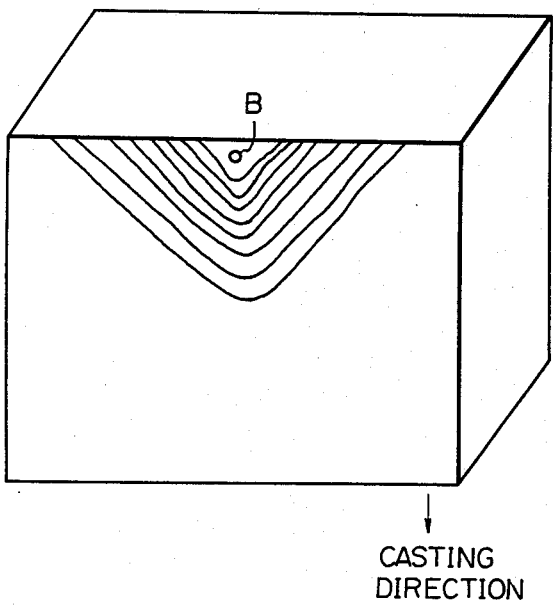
FIG. 44 schematically shows the surface shape of a casting which is predicted to BO within a mold.

FIG. 43 illustrates the results of experiments for investigating the BO generation. In these experiments, the casting speed was 1.2 m/min and constant and the oscillation parameters were changed to obtain the $T_N$ time ranging from 0.17 to 0.29 second. The mold was oscillated by a sine wave shown in FIG. 30. The BO numbers relative to the casting time are indicated by an index. As is apparent from FIG. 43, BO did not occur when the $T_N$ time was adjusted to 0.25 second or longer. In addition, in several casting operations with a $T_N$ time of 0.25 second or longer, a BO was predicted. The castings obtained by such operations were observed. The results are shown in FIG. 44. The constraint started at the point B and the rupture of the solidifying shell propagated radially. The rupture was restored, however, in the mold during the growth of a solidifying shell in the mold, so that the rupture did not result in a BO.

[Fourth Example]

The present invention was implemented in a curved type continuous casting plant having a monthly production capacity of 160,000 tons. The casting parameters are given in Table 2.

TABLE 2

| | |
|---|---|
| Casting Speed | 1.6 (m/min) |
| Number of Oscillations of Mold | 54 Vc + 40 (cpm) |
| Amplitude of Mold | 12 (mm) |
| Oscillation Wave of Mold | Sine Wave |
| Casting Width | 1000 (mm) |
| Casting Thickness | 250 (mm) |

The rupture was detected by embedded thermocouples within a mold, measuring the temperature during continuous casting, and calculating the temperature-change pattern. The rupture was detected at approximately 300 mm beneath the level of molten steel, that is, the constraint of a solidifying shell generated at such a level was detected.

Figure 45:
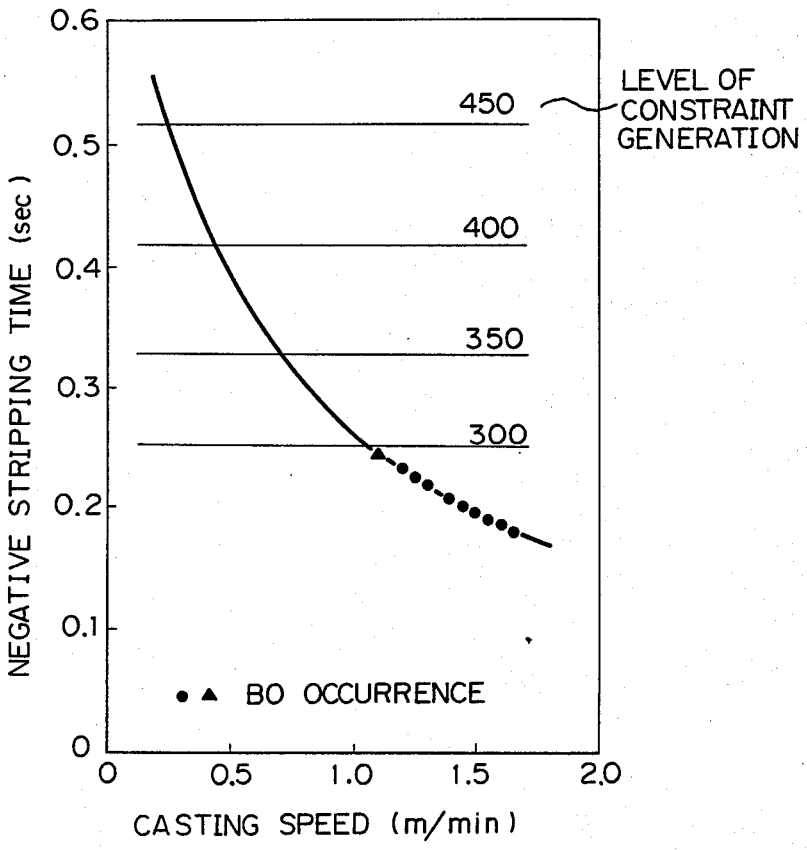
FIG. 45 is a graph showing a relationship between the negative stripping time $T_N$ and casting speed for the cases of BO's which occurred in the continuous casting machine before implementing the method according to the present invention.

Referring to FIG. 45, a relationship between the $T_N$ time and the casting speed is shown for the continuous casting operations in the past, in which a BO was generated. When the $T_N$ time and casting speed were as shown by the symbol ▲, the constrained part 41*a* (FIG. 36) was bonded to a lower part of the casting. As long as the constrained part 41*a* sticks to the mold, the constrained part 41*a* should remain within the mold when a BO is generated. The level of constraint-generation of 300 mm, which corresponds to the symbol ▲, is therefore construed to be the level where constraint force between the solidifying shell and mold is relieved. The $T_N$ time necessary for repairing or restoring the ruptured, solidifying shell is 0.25 second or longer, as understood from FIG. 39, which teaches that $T_N$=0.25 second for the level of constraint-generation of 300 mm.

When the casting speed was to be reduced, it was reduced to 0.7 m/min while maintaining the other casting parameters. The casting speed was maintained at 0.7 m/min for 30 seconds so as to obtain a solidifying shell at least equal to that growing, under an ordinary circumstance, at the lower end of a mold. Then the casting speed was gradually increased.

Figure 46:
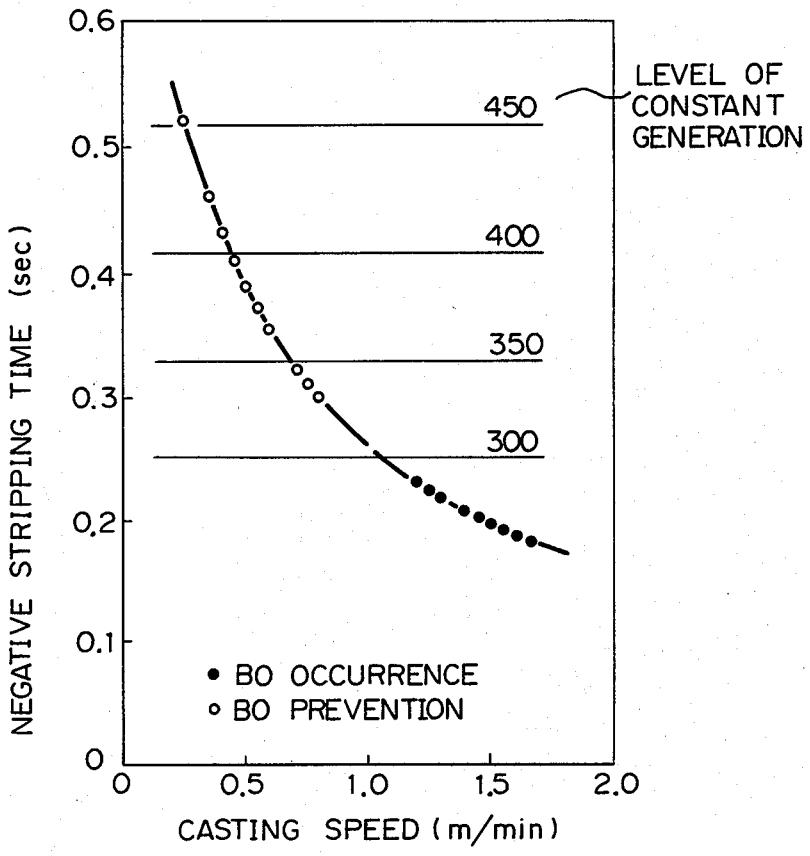
FIG. 46 is a graph similar to FIG. 45, resulting from investigation by the present inventors.

FIG. 46 illustrates an example of the casting operations under the parameters given in Table 2, in which the BO occurred (•) and could be prevented (o). As is apparent from FIG. 46, when the level of constraint-generation is 300 mm or more beneath the bath level, the reduction in casting speed down to 0.7 m/min is sufficient for preventing BO. Using the curve shown in FIG. 46, the reduction patterns of the casting speed can be set depending upon the position of defect-generation in order for avoiding cast defects. If, during the reduction of casting speed in accordance with a selected pattern, another defect, which necessitates a greater reduction in casting speed, is detected, the once selected pattern is modified and another pattern is set to avoid the cast defect from being formed due to that another defect.

The reduced casting speed is reverted to an ordinary state when the cast defect is avoided. The timing for reversion may be determined by any means, an arithmetic logic unit which can calculate the time when the defect passes the bottom end of a mold may be used. In this arithmetic logic unit, such a time is calculated by using the casting speed and the mold length. In addition, a predictor 11 may be used, so that a speed-increase instruction is generated when the ordinary state is detected, that is, when the predictor 11 does not produce cast-defect generation signals. The temperature-increasing rate, when reverting to the ordinary casting speed, is determined by the past experiments in the casting operations, in which the casting speed-increase is instructed by any means. It is possible, during the stage of casting-speed increase, to use the predictor 11 to monitor the generation of a cast defect and to gradually increase the casting speed while detecting a cast defect.

The casting-speed changing pattern herein is selected and set depending upon the kind and position of a cast defect and includes the reduction pattern of the casting speed and also the increase patterns of the casting speed to an ordinary state. In addition, the casting-speed changing pattern also includes, in the case where the cast defect is a rupture of a solidifying shell, changng of the oscillation number which is controlled at a certain relationship with the casting speed.

Referring again to FIG. 1, a casting-speed changing pattern is selected in the unit for setting a casting speed 12, so that the selected pattern is appropriate for the specific defect detected. The instruction signal is then transmitted based on the selected pattern to the casting speed controlling unit 13. This unit 13 then controls the rotation number of the driven rolls 14 in accordance with the instruction signal and thus adjusts the withdrawal speed to a predetermined speed.

The above mentioned instruction signal is also input from the unit for setting a nozzle-opening degree 15, in which the opening degree of a sliding nozzle 6 for obtaining a flow rate of molten steel commensurate with the changed casting speed is set by utilizing the actual casting speed which is obtained by detecting the rotation number of the driven rolls 14 by the detector 19. The so set opening degree is sent via a sliding nozzle controlling unit 16 to the sliding nozzle driving unit 18. The sliding nozzle controlling unit 16 appropriately controls the opening degree of the nozzle, based on the instruction signal from the unit 16 and also the signal from the feedback controlling unit of the bath level 17. The bath level in the mold therefore can be controlled within a predetermined range even when the casting speed is drastically changed.

Figure 47A:
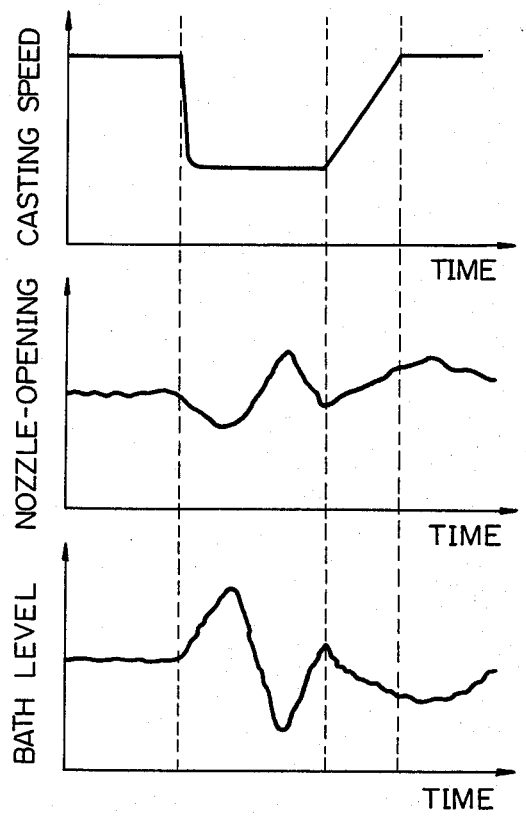
FIGS. 47(A) and (B) illustrate the methods for controlling nozzle-opening according to the conventional manner and the feedback manner of the present invention, respectively.
Figure 47B:
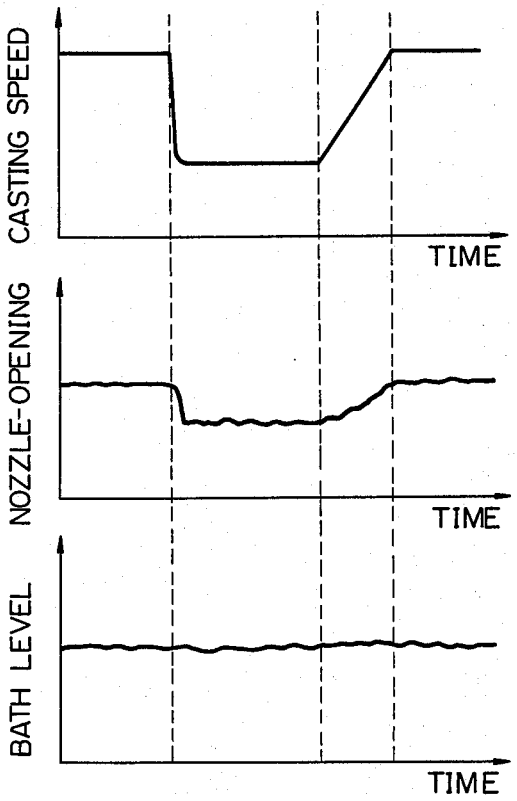

The method for controlling the opening-degree of a nozzle according to the present invention and the conventional method which is principally a feedback controlling method illustrated in FIGS. 47(B) and (A), respectively, are compared with one another. In the conventional method illustrated in FIG. 47(A), when the casting speed is reduced upon the prediction of a cast defect, followed by a rise in the bath level, the rise in the bath level is detected and then the control is carried out to change the opening degree of a nozzle. The bath level therefore greatly varies and, in an extreme case, the molten steel overflows. An operator must therefore monitor the bath level and manually control the same in an abnormal circumstance. Contrary to this, according to the present invention, there occurs virtually no change in the bath level, since the opening-degree of a nozzle is controlled simultaneously with the change of casting speed, while carrying out the feedback control based on the detection of the bath level. According to the present invention, the cast defects can be effectively eliminated, and no detrimental influence is caused by the control of a bath level, upon the qualities of a casting.

[Fifth Example]

In the same continuous casting plant (curved type, monthly production of 160,000 tons) as in the fourth example, the method according to the present invention was implemented. The operating conditions are given in Table 3.

TABLE 3

| | | |
|---|---|---|
| Casting | Steel Grade | Low C, Al-killed steel |
| | Width | 1000 mm |
| | Thickness | 250 mm |
| Casting Speed | | 1.6 m/min |
| Mold | Number of Oscillations | 54 × Casting Speed (m/min) + 40 (cpm) |
| | Amplitude | 12 mm |
| | Oscillation Wave | Sine Wave |
| Level of Bath | | Ranging 90–100 mm from Top End of Mold |

The apparatus illustrated in FIG. 1 was used for predicting the cast defects. Six temperature-detecting terminals 7 were embedded in a wide side of the continuous casting mold, in three rows along the direction y along the width and in two rows along the casting direction x. The distances of the two rows of temperature-detecting terminals 7 from the top end of mold were 260 mm and 400 mm. The distance between the three rows in the direction y along the width was 250 mm.

Figure 48:
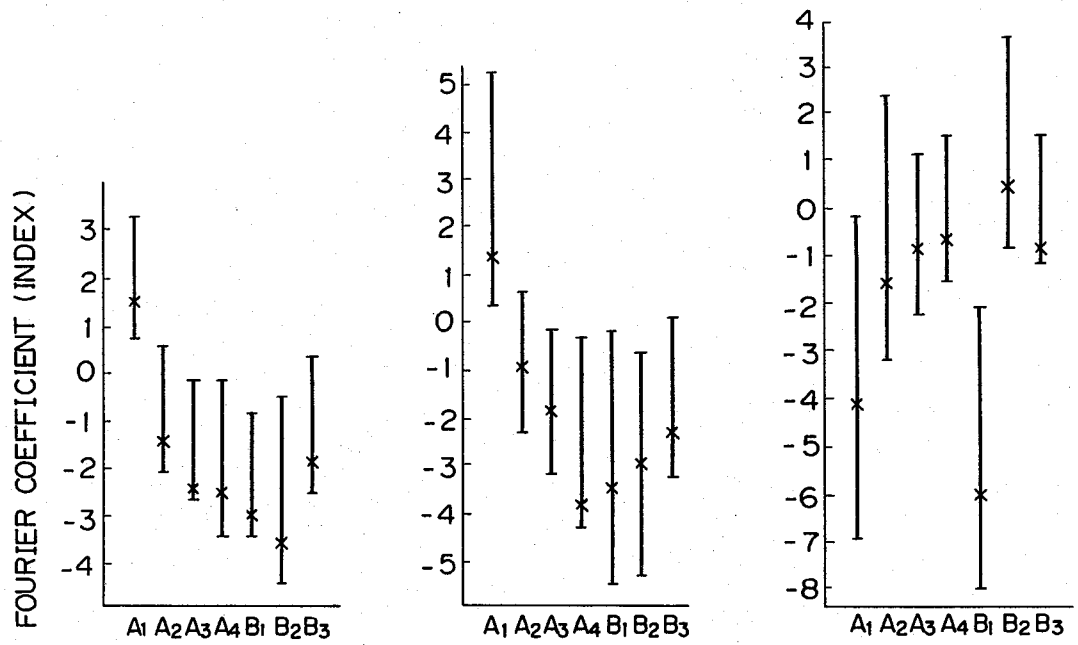
FIG. 48 illustrates a prediction of a constraint BO according to an example of the present invention.
Figure 49:
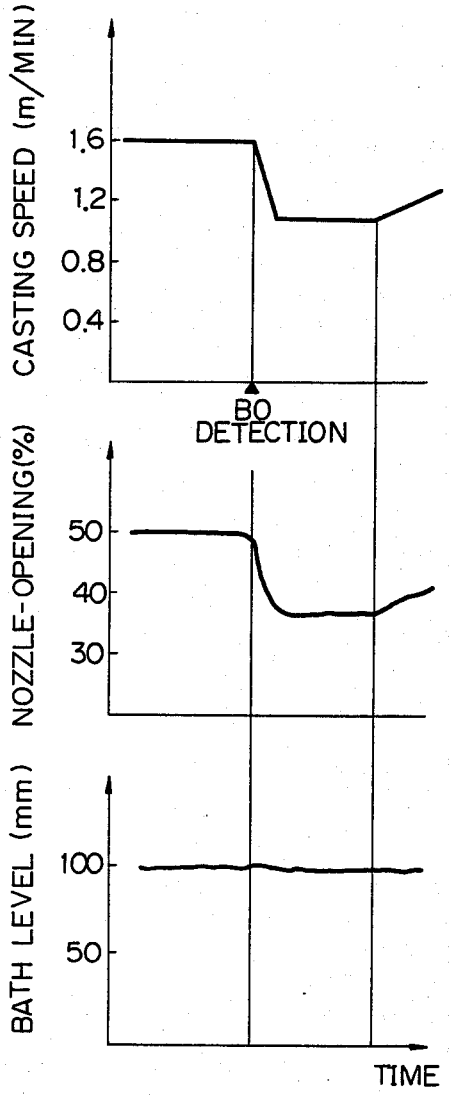
FIG. 49 illustrates how the casting speed and nozzle-opening are controlled in accordance with the instruction for changing the casting speed shown in FIG. 48, and how the bath level varies in accordance with this control.

The Fourier transforming functions of the predictor 11 were the same as in the first example. FIGS. 48(A), (B), (C) correspond to the temperature values detected at the left, middle, and right temperature-detecting terminals 7, arranged in the direction along the width of a casting. The solid lines indicate the defect generating-power coefficients. The power coefficients of the respective terms of the Fourier series obtained by transforming the temperature-detecting terminals **7*b* were calculated in the predictor 11 as shown by the x marks in FIGS. 48(A), (B), and (C). The constraint BO was thus predicted. The bath level was 100 mm beneath the top end of mold, when the constraint BO was predicted, and the level of constraint-generation was approximately 300 mm beneath the bath level. A casting-speed changing pattern, which can avoid the constraint BO, was selected and set, using FIG. 39 under the conditions of a detected kind of a cast defect (constraint BO) and its generating position (approximately 300 mm beneath the bath level) as well as under the operating conditions mentioned above. The negative stripping time, which can avoid the cast defect, turned out to be 0.25 second, and the casting speed to attain the negative stripping time of 0.25 second turned out to be 1.1 m/min or less. The controlling instruction based on these results was therefore transmitted to the casting speed controlling unit 13 and the nozzle-opening degree setting unit 15. FIG. 49** shows how the casting speed and opening degree of the nozzle were controlled in accordance with the controlling instruction and how the bath level varied in accordance with such controls. It was detected that the cast defect completely disappeared 40 seconds after the BO prediction. The reduction in casting speed was 0.5 m/min and was the minimum. Trouble caused by a casting anomaly did not occur.

Figure 50:
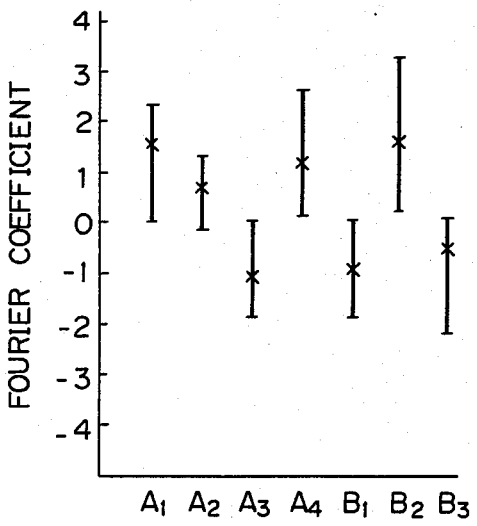
FIG. 50 illustrates a prediction of an engulfing BO according to an example of the present invention; and, FIG. 51 illustrates how the casting speed and nozzle-opening are controlled in accordance with the instruction for changing the casting speed shown in FIG. 50, and how the bath level varies in accordance with this control.
Figure 51:
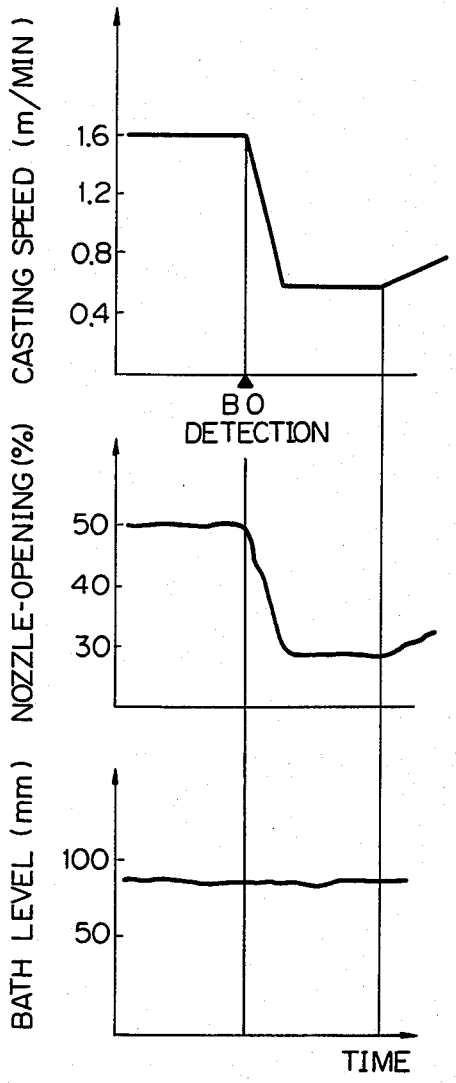

In another continuous casting, the coefficients of the respective terms, which were obtained by Fourier transforming in the predictor 11, the temperature values input thereto at each moment, fell within the range of power coefficients indicating the generation of an engulfing BO, as shown in FIG. 50. Thus an engulfing BO was predicted. Since the bath level was 100 mm beneath the top end of a mold, when the engulfing BO was predicted, the level of constraint-generation was approximately 300 mm beneath the bath level. A casting-speed changing pattern, which can avoid the engulfing BO, was selected and set, using FIG. 29 under the conditions of the detected kind of a cast defect (engulfing BO) and its generating position (approximately 300 mm beneath the bath level) as well as under the operating conditions mentioned above. In the pattern selected and set as above, the casting speed was changed from 1.6 m/min to 0.61 m/min. The controlling instruction based on these results was therefore transmitted to the casting speed controlling unit 13 and the nozzle-opening degree setting unit 15. Referring to FIG. 51, it is shown how the casting speed and opening degree of the nozzle were controlled in accordance with the controlling instruction and how the bath level varied in accordance with such controls. The BO was prevented completely and a stable operation continued, since the cast defect was predicted at an early stage and an appropriate operating action was taken.

As described in detail hereinabove, in accordance with the present invention, the generation of cast defects can be accurately predicted with regard to the kinds and position thereof, and an optimum action for avoiding the cast defects can be automatically taken in accordance with the prediction. As a result, serious trouble such as BO are avoided and the normal bath-level can be always maintained. The qualities of castings produced can therefore be improved considerably. In addition, the automatic action enables the operators to be exempted from physical and mental loads.

We claim:

1. A method for avoiding a cast defect in a continuous casting, wherein molten steel is poured into a mold so as to form a casting and the casting is withdrawn from the mold, comprising the steps of:

using the mold, in which temperature-detecting terminals are embedded;

obtaining a first sequential temperature-change pattern by each of said temperature-detecting terminals, each first sequential temperature change pattern being a plurality of temperature reading each spaced from one another in predetermined time intervals;

setting second sequential temperature-change patterns representing past generation of cast defects in continuous casting operations, as previously detected by each of said temperature-detecting terminals, each second sequential temperature-change pattern being a plurality of temperature readings each spaced from one another in predetermined time intervals;

comparing said first sequential temperature change-pattern with said second sequential temperature-patterns;

predicting the cast defect when said first sequential temperature change-pattern conforms to any of said second sequential temperature change-patterns, and determining a kind of a cast defect and a position of a cast defect corresponding to an embedded position of or a region between the temperature-detecting terminals by said prediction;

setting casting speed-changing patterns, each of which enable prevention of the cast defect from generating on the casting withdrawn from the mold, depending upon a respective kind and position of the cast defect;

selecting one of said casting speed-changing patterns so as to enable prevention of said predicted cast defect of the casting being withdrawn from the mold; and, changing the casting speed based on the selected one pattern.

2. A method according to claim 1, wherein addition to the casting-speed control, a rate of which molten steel is poured into the mold is simultaneously controlled.

3. A method according to claim 1 or 2, wherein the second sequential temperature-change pattern is quantitatively determined by Fourier-transforming the sequential-temperature change pattern for casting operations, in which the cast defects are generated in past, so as to obtain coefficients of respective terms of Fourier series, and then determining a correlation between said coefficients of respective terms and the generation of a cast defect so as to preset power coefficients of the respective terms, in which the cast defect is generated, and the first sequential temperature change-pattern is quantitatively determined by Fourier-transforming the temperature values detected by said temperature-detecting terminals, so as to obtain coefficients of respective terms of the Fourier series, and, when these coefficients fall within said preset power coefficients of respective terms, the prediction of the cast defect is made with regard to said kind and position.

4. A method according to claim 1 or 2 wherein said mold being used has four adjoining walls defining four corners with each corner being formed by two adjacent walls and said mold has a height parallel to the direction from which said casting is withdrawn from said mold, said method further comprising:

locating said temperature-detecting terminals at said corners at essentially an identical level along said mold height, detecting temperature values at said corners, obtaining temperature differences $\Delta T_1$ and $\Delta T_2$ between two pairs of opposite corners, obtaining said first sequential temperature change pattern by calculating the different $\delta$ between $\Delta T_1$ and $\Delta T_2$, setting said second sequential temperature change patterns which represent post-casting circumstances when the cast defect is in the form of a corner surface crack by obtaining a correlation between $\delta$ and past formations of corner surface cracks, predicting the formation of said cast defect in the form of surface corner cracks when the first sequential temperature change pattern corresponds to said second sequential temperature change pattern.

5. A method according to claim 1 or 2 comprising:

locating a plurality of said temperature-detecting terminals in said mold arranged in the moving direction of said casting, obtaining said first sequential temperature pattern from said terminals, setting said second sequential temperature change patterns corresponding to an engulfing break-out caused by engulfing inclusions, said second sequential temperature change patterns comprising successive shifts of the temperature values detected by said temperature-detecting terminals, said shifts occurring successively in time between at least two temperature-detecting terminals arranged in the moving direction of said casting and representing a temperature fall from a steady level at which an engulfing break-out does not form on the casting withdrawn from the mold to a low level representing formation of an engulfing break-out, predicting the engulfing break-out when the first sequential temperature change pattern conforms to the second sequential temperature change pattern.

6. A method according to claim 1 or 2 wherein said mold is oscillated in periodic cycles with respect to the direction of movement of said casting through the mold during said casting, establishing a correlation between negative stripping times wherein said mold oscillates in the direction of movement of said casting at a speed greater than the speed of withdrawal of said casting from the mold and said second sequential temperature change pattern corresponding to rupture break-out cast defects caused by a part of the solidifying shell of said casting being constrained by the inner surface of said mold to establish predetermined negative stripping times that permit the solidifying shell to grow within said mold to repair corresponding rupture break-outs within said mold, predicting a rupture break-out cast defect by said comparing of said first sequential temperature change patterns with said second sequential temperature change patterns, changing the casting speed in response to the predicted rupture break-out to attain the predetermined negative stripping time required to repair the predicted rupture break-out cast defect within said mold.

7. A method according to claim 6, wherein said negative stripping time to be attained is 0.25 second or more.

8. An apparatus for preventing a cast defect in a continuous casting plant comprising:

a plurality of temperature-detecting terminals embedded in a continuous casting mold along a casting direction (x) and a direction of its width (y);

means associated with each temperature-detecting terminal for providing a first sequential temperature-change pattern for each temperature-detecting terminal, each first sequential temperature-change pattern being a plurality of temperature readings each spaced from one another in predetermined time intervals;

means for storing second sequential temperature change patterns representing past generation of cast defects in continuous casting operations as previously detected by each of said temperature-detecting terminals, each second sequential temperature change pattern being a plurality of temperature readings each spaced from one another in predetermined time intervals;

means for predicting the cast defect when said first sequential temperature change-pattern conforms to any of said second sequential temperature change-patterns, and means for determining a kind of a cast defect and a position of a cast defect corresponding to an embedded position of or a region between the temperature-detecting terminals responsive to said prediction;

means for setting casting speed-changing patterns, each of which enable prevention of the cast defect from generating on the casting withdrawn from the mold, depending upon a respective kind and position of the cast defect;

means for selecting one of said casting speed-changing patterns so as to enable prevention of said predicted cast defect of the casting being withdrawn from the mold; and, means for changing the casting speed based on the selected one pattern.

* * * * *

UNITED STATES PATENT AND TRADEMARK OFFICE

CERTIFICATE OF CORRECTION

PATENT NO. : 4,774,998

DATED : October 4, 1988

INVENTOR(S) : A. Matsushita, et al.

It is certified that error appears in the above-identified patent and that said Letters Patent is hereby corrected as shown below:

ABSTRACT, line 3, change "takes and appropriate" to --takes an appropriate--.

Column 3, line 58, between "comparison" and "the" insert --of--.

Column 6, line 36, change "a example of" to --an example of--.

Column 7, line 24, change "views" to --view--.

Column 8, line 18, change "detects" to --defects--.

Column 9, line 15, change "obtained" to --obtaining--.

Column 10, line 15, change "7a" to --7b--.

Column 13, line 50, change "presuming" to --predicting--.

Column 14, line 4, change "701a-701a" to --701a-701d--.

Column 14, line 34, change "was" to --were--.

Column 14, line 56, change "a the defect-" to --as the defect---.

UNITED STATES PATENT AND TRADEMARK OFFICE

CERTIFICATE OF CORRECTION

PATENT NO. : 4,774,998

DATED : October 4, 1988

INVENTOR(S) : A. Matsushita, et al.

It is certified that error appears in the above-identified patent and that said Letters Patent is hereby corrected as shown below:

Column 16, line 58, change "shell 4" to --shell 41--.

Column 17, line 18, change "crtain" to --certain--.

Column 17, line 42, change "substraction" to --subtraction--.

Column 19, line 13, change "In" to --An--.

Column 19, line 33, change "not withstanding" to --notwithstanding--.

Column 19, line 38, change "speedreduction" to --speed-reduction--.

Column 20, line 12, change "conacting" to --contacting--.

Column 20, line 30, omit "a" before "schematically".

Column 21, lines 12, 16, and 22, change $\sigma$ to $\bar{\sigma}$,

Column 22, line 14, change $\sigma$ to $\bar{\sigma}$.

UNITED STATES PATENT AND TRADEMARK OFFICE

CERTIFICATE OF CORRECTION

PATENT NO. : 4,774,998

DATED : October 4, 1988

INVENTOR(S) : A. Matsushita, et al.

It is certified that error appears in the above-identified patent and that said Letters Patent is hereby corrected as shown below:

Column 21, line 68, change "F*a" to --F*$\sigma$ --.

Column 22, lines 6, 9 and 14, change "T" to --$\bar{T}$--.

Column 23, line 9, change "Vc $\angle$ 1.0 to --Vc $\leqq$ 1.0--.

Column 23, line 11, change "Vc $<$ 0.4 to --Vc $\leqq$ 0.4--.

Column 23, line 12, change "Vc $\angle$ 1.0 to --VC $\leqq$ 1.0--.

Column 24, line 32, between "where" and "constraint" insert --the--.

Column 25, line 13, change "pattern" to --patterns--.

Column 25, line 17, change "changng" to --changing--.

Column 27, line 45, change "reading" to --readings--.

UNITED STATES PATENT AND TRADEMARK OFFICE

CERTIFICATE OF CORRECTION

PATENT NO. : 4,774,998

DATED : October 4, 1988

INVENTOR(S) : A. Matsushita, et al.

It is certified that error appears in the above-identified patent and that said Letters Patent is hereby corrected as shown below:

Column 28, line 44, change "different" to --difference--.

Column 29, line 21, change "pattern" to --patterns--.

Signed and Sealed this

Sixth Day of June, 1989

*Attest:*

*Attesting Officer*

DONALD J. QUIGG

*Commissioner of Patents and Trademarks*